US008120562B2

(12) United States Patent
Watanabe

(10) Patent No.: US 8,120,562 B2
(45) Date of Patent: Feb. 21, 2012

(54) LIQUID CRYSTAL DEVICE, ACTIVE MATRIX SUBSTRATE, AND ELECTRONIC APPARATUS

(75) Inventor: Kenya Watanabe, Suwa (JP)

(73) Assignee: Sony Corporation, Tokyo (JP)

( * ) Notice: Subject to any disclaimer, the term of this patent is extended or adjusted under 35 U.S.C. 154(b) by 1133 days.

(21) Appl. No.: 11/940,084

(22) Filed: Nov. 14, 2007

(65) Prior Publication Data

US 2008/0129905 A1 Jun. 5, 2008

(30) Foreign Application Priority Data

Dec. 5, 2006 (JP) ..... 2006-328223

(51) Int. Cl.
*G09G 3/36* (2006.01)

(52) U.S. Cl. ..... 345/93; 345/87; 345/90; 345/92; 349/84; 349/113

(58) Field of Classification Search ..... 345/84, 345/87, 90, 92, 93; 349/56, 84, 113, 114, 349/115

See application file for complete search history.

(56) References Cited

U.S. PATENT DOCUMENTS

| | | | | |
|---|---|---|---|---|
| 6,750,836 | B1 * | 6/2004 | Katayama et al. | 345/92 |
| 7,095,391 | B2 * | 8/2006 | Lee | 345/87 |
| 2005/0190133 | A1 * | 9/2005 | Kawachi | 345/87 |
| 2008/0238850 | A1 * | 10/2008 | Watanabe | 345/90 |

FOREIGN PATENT DOCUMENTS

| | | |
|---|---|---|
| JP | A 05-303077 | 11/1993 |
| JP | A 08-286170 | 11/1996 |
| JP | A 2001-337339 | 12/2001 |
| JP | A 2005-25048 | 1/2005 |
| JP | A 2005-148453 | 6/2005 |

* cited by examiner

*Primary Examiner* — My-Chau T Tran
(74) *Attorney, Agent, or Firm* — K&L Gates LLP

(57) ABSTRACT

A liquid crystal device includes a liquid crystal element having a first pixel electrode and a second pixel electrode which control alignment of liquid crystal molecules by applying an electric field in a direction parallel to a surface of a substrate to a liquid crystal layer, a memory circuit which is disposed in a pixel circuit and which serves as a voltage source of a first voltage and a second voltage, and an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element.

10 Claims, 14 Drawing Sheets

LIQUID CRYSTAL DEVICE, ACTIVE MATRIX SUBSTRATE, AND ELECTRONIC APPARATUS

BACKGROUND

1. Technical Field

The present invention relates to a liquid crystal device, an active matrix substrate, and an electronic apparatus.

2. Related Art

Reflective type liquid crystal devices are mounted on electronic apparatuses, such as cellular phone, notebook computer, and reflective type projector. The reflective type liquid crystal device has a structure in which a liquid crystal layer is interposed between a glass substrate or a silicon substrate provided with data lines, scan lines, switching elements such as transistors, storage capacitors, and reflective type pixel electrodes made of aluminum and a glass substrate provided with a counter electrode which is a transparent electrode. Since the pixel electrodes are reflective type, it is possible to dispose the switching elements, such as transistors under the pixel electrodes and to increase resolution while avoiding the decrease of an aperture ratio. That is, it is relatively easy to achieve both high resolution and high brightness.

However, in the case of using a pixel circuit based on an analog system which maintains a constant pixel voltage by the use of a storage capacitor, there is a problem in that brightness and contrast of a display image may easily change because a voltage of the storage capacitor becomes lowered as time passes.

In order to solve this problem, JP-A-8-26170 suggests a liquid crystal device in which bits of memory cells are disposed under respective reflective type pixel electrodes of pixels for every pixel. In the liquid crystal device having pixels each provided with a bit of memory cell, image signals from the data lines are latched by the memory cells and the latched signals are applied to the liquid crystal layer of the pixels. The memory cell maintains a previously input signal until a new signal is input. Accordingly, it is possible to effectively perform display switching operation in a simple manner, in which a still image is saved in a memory first, a different image is then displayed, and finally the image saved in the memory is displayed again. Further, it is also possible to suppress degradation of display quality attributable to crosstalk by digitizing the pixel voltage.

JP-A-5-303077 discloses an effective technique in which a voltage polarity applied to a liquid crystal is periodically inverted in order to prevent image sticking (deterioration of a display image attributable to a phenomenon in which liquid crystal molecules are aligned in a certain direction) from occurring when a direct current voltage is applied to a liquid crystal.

A circuit structure of the liquid crystal device having pixels each provided with a memory cell is disclosed in JP-A-2005-148453 and JP-A-2005-25048. The techniques disclosed in JP-A-2005-148453 and JP-A-2005-25048 are common in the point that voltage polarities applied to one electrode and a counter electrode (common electrode) of a liquid crystal are periodically inverted. According to the technique disclosed in JP-A-2005-148453, decision that which of complementary signals which can be obtained from a static random access memory (SRAM) is supplied to the liquid crystal is made by switching on/off of a transistor. According to the technique disclosed in JP-A-2005-25'048, since an offset voltage generated when a voltage polarity applied to a liquid crystal is inverted causes image sticking, an offset voltage applied to the counter electrode (common electrode) adjusted in a manner such that response waveforms obtained by the output from an optical sensor become equal to each other for every field.

As for a liquid crystal device, there is known a liquid crystal device in which alignment of liquid crystal molecules is controlled by applying an electric field in a direction parallel to a surface of a substrate to a liquid crystal layer. With reference to JP-A-2001-337339, the liquid crystal device is called an In-Plane Switching (IPS) system or a Fringe-Field Switching (FFS) system liquid crystal device depending on the shape of electrodes by which an electric field applied to a liquid crystal is generated. In the lateral electric field system liquid crystal device, light transmittance is controlled by rotating horizontally aligned liquid crystal molecules in a lateral direction. Since liquid crystal molecules are not tilted to a vertical direction at an angle, brightness and color variation attributable to a viewing angle are small. Accordingly, the lateral electric field system liquid crystal device can be used for applications needing a wide viewing angle and a high quality chromic characteristic.

In order to prevent sticking of a liquid crystal from occurring, a direct current voltage must not be applied to a liquid crystal for a long time. FIGS. 13A and 13B are views illustrating the operation of preventing sticking from occurring in the liquid crystal device. FIG. 13A shows an operation state in which a voltage is applied to a liquid crystal and FIG. 13B shows an operation state in which a voltage is not applied to the liquid crystal. FIGS. 13A and 13B relate to a twisted nematic liquid crystal device (TN LCD) in which an electric field is applied to a liquid crystal layer in a direction perpendicular to a surface of a substrate.

As shown in FIG. 13A, in the case in which a voltage is applied to a liquid crystal 400, a voltage polarity applied to the liquid crystal 400 is periodically inverted in order to prevent image sticking from occurring. That is, a polarity of a voltage applied to each of terminals X1 and X2 in this figure is periodically switched. Further, the liquid crystal 400 have a lower electrode Lp and an upper electrode (common electrode) LCcom on both sides thereof.

As shown in FIG. 13B, in order to prevent image sticking from occurring in the case in which a voltage is not applied to the liquid crystal 400, the lower electrode Lp and the upper electrode (common electrode) LCcom must have the same potential, which is achieved by causing a short-circuit between the lower electrode Lp and the upper electrode LCcom. To this end, it is important that a direct current offset is not generated. In FIG. 13B, for convenience's sake, it is possible to make the electrodes of the liquid crystal be short-circuited using a switch SW1. However, in practical, the shore-circuited state of the electrodes of the liquid crystal 400 is accomplished by applying the same voltage to the electrodes.

However, in the liquid crystal device having pixels each with a memory circuit, as schematically shovel in FIGS. 13A and 13B, it is difficult to realize ideal operation (ideal polarity inverting operation and electrode short-circuiting operation for preventing image sticking from occurring).

FIGS. 14A to 14C relate to a liquid crystal device including pixels each with a memory circuit. FIGS. 14A to 14C are views for explaining problems encountered when inverting voltages applied to both electrodes of the liquid crystal.

As for a method of inverting polarities of voltages applied to both electrodes of a liquid crystal, as shown in FIG. 14A, there is known a method in which a voltage Vcom of the counter electrode (common electrode) is fixed and a voltage Vp applied to the lower electrode Lp is inverted. Further, as shown In FIG. 14B, there is known an alternative method in which both voltages Vp and Vcom applied to the lower electrode Lp and the common electrode LCcom, respectively, are simultaneously inverted in their polarities. In FIGS. 14A to 14C, the voltages applied to the liquid crystal are 5V and 0V.

It is convenient to employ the method shown in FIG. 14A because it does not need to change a potential (Vcom=0V) of the counter electrode (common electrode) LCcom. However, a negative power source must be used for this method because it needs to change the voltage (Vp) of the lower electrode Lp relative to the potential Vcom. Since it is impractical to drive the memory circuits provided to the pixels using a negative power source, the method shown in FIG. 14A cannot be used in the liquid crystal device with memory circuits.

For such a reason, there is no other choice but to use a method of simultaneously changing voltages Tip and Vcom applied to the lower electrode Lp and the common electrode LCcom as shown in FIG. 14B. However, this method has a problem in that the liquid crystal layer interposed between the substrates acts as a capacitor as a whole and thus the voltage changing is slow because the counter electrode (common electrode) LCcom is a common electrode shared by all pixels.

That is, as shown in FIG. 14C, load of the lower electrode Lp is light because one lower electrode Lp corresponds to only one pixel. Thus, at a time t1 when voltages applied to both electrodes of a liquid crystal are inverted, the voltage Vp applied to the lower electrode Lp can be rapidly changed. On the other hand, the voltage applied to the counter electrode (common electrode) LCcom is changed after a lapse of transition time T1 (from t1 to t2) because the counter electrode has heavy load as shown in FIG. 14C. As a result, in the transition time T1, the voltage applied to the liquid crystal gradually varies as time passes. The change of light transmittance which is attributable to the voltage change is readily caught by the eye and thus flickers (complementary flickers) occur.

In order to control voltage inverting operation shown in FIG. 14B, the voltage Vp and the voltage Vcom must be individually controlled by different control circuits, respectively and thus it is natural that the circuit structure is complex.

FIGS. 15A and 15B are explanatory views for explaining the problem with the short-circuited state (the same potential state) of the electrodes of the liquid crystal in a liquid crystal device with pixel circuits each having a memory circuit. As shown in FIG. 15A, the electrodes Lp and LCcom of the liquid crystal 400 are applied with different ground potentials GND1 and GND2 from different circuits (wirings), respectively. However, as for the ground potentials GND1 and GND2 applied to the electrodes Lp and LCcom via the different circuits (wirings), since voltage levels therefore independently vary, there is a relative voltage difference between them.

Further, since the electrodes Lp and LCcom of the liquid crystal have two-dimensional broadening, the voltages Vp and Vcom of the electrodes vary over their entire areas and thus a direct current offset between both electrodes in each pixel may be generated.

Accordingly, as shown in FIG. 15B, it happens that a direct current offset voltage ΔV is generated between the electrodes opposing each other in each pixel of the liquid crystal 400. In FIG. 15B, Vgnd1 and Vgnd2 denote voltages applied to both the electrodes in each pixel of the liquid crystal, in which the voltages Vgnd1 and Vgnd2 are set considering local irregularity of voltage in planes of the electrodes. The direct current offset voltage ΔV leads to occurrence of image sticking.

In the liquid crystal device including pixels each provided with a memory circuit, it is difficult to achieve the perfect short-circuited state in which voltage inverting is performed in order to prevent image sticking from occurring while avoiding the flickers and without generating the direct current offset. Further, since the voltages applied to the electrodes Lp and LCcom of the liquid crystal must be individually controlled, the circuit structure is very complex.

SUMMARY

An advantage of some aspects of the invention is that it provides a liquid crystal device which is capable of preventing image sticking from occurring by Inverting application voltages with high precision while inhibiting flickers from occurring by the use of a simple circuit structure and a simple control method and capable of realizing a short-circuited state of electrodes without generating a direct current offset when a voltage is not applied to a liquid crystal.

A first aspect of the invention provides a liquid crystal device including a lateral electric field system liquid crystal element having a first pixel electrode and a second pixel electrode which controls alignment of liquid crystal molecules by applying an electric field parallel to a surface of a substrate to a liquid crystal, a memory circuit which is disposed in a pixel circuit and which serves as a voltage source of a first voltage and a second voltage, and an application voltage inverting circuit which is disposed in the pixel circuit and which inverts voltages applied to the liquid crystal molecules by controlling each of the first voltage and the second voltage supplied from the memory circuit so as to be supplied to either the first pixel electrode or the second pixel electrode of the liquid crystal element.

The lateral electric field system liquid crystal has a structure in which two electrodes corresponding to one pixel are provided to either one of two substrates with liquid crystals interposed in between. Accordingly, the lateral electric field system liquid crystal element has a small load capacity in comparison with a TN liquid crystal element having a common electrode LCcom shared by all pixels. That is, load capacity of the lateral electric field system liquid crystal element is an amount corresponding to only one pixel. Accordingly, in the case of inverting voltages applied to the liquid crystal, voltages applied to all electrodes can be rapidly changed. The invention is based on such characteristics of the lateral electric field system liquid crystal element and thus the invention positively employs the lateral electric field system liquid crystal element. Further, the liquid crystal device adopts a novel pixel circuit structure in which a voltage supply source and a voltage inverting function are completely separated from each other. That is, a memory circuit is used as a voltage supply source and a voltage inverting operation which inverts a voltage applied to the liquid crystal is performed by the use of the application voltage inverting circuit which is separately provided from the memory circuit. The application voltage inverting circuit is operated using a first voltage or a second voltage supplied from the memory circuit (for example, 5V (VDD) or 0V (GND) corresponding to "1" or "0") as a power source voltage. That is, the application voltage inverting circuit is operated between the power source voltage (the first voltage or the second voltage) supplied from the memory circuit and a reference power source potential (ground) and switches supply paths of the voltage (the first voltage or the second voltage) supplied from the memory circuit and the reference power source voltage (ground) so as for each of the power source voltage and the reference power source potential to be supplied to either the first electrode or the second electrode of the lateral electric field system liquid crystal element. That is, since the voltage supply paths are switched but the voltage sources themselves are not changed, there is no variation in voltage values before and after the voltage inverting operation and thus the voltage polarity inversion can be precisely accomplished. Due to the in-plane local irregularity in distribution of liquid crystals, voltage levels in the pixels may be slightly different for every pixel. However, since the voltage source itself is common for every pixel and the voltage value does not change in each pixel before and after the voltage inversion operation, a direct current offset does not occur in each pixel. Further, the voltage levels supplied to the first pixel electrode and the second pixel electrode can be simultaneously inverted by switching voltage supply paths by the use of a simple circuit. Accordingly, it does not need to control the voltage Vcom applied to the common electrode and the voltage Vp applied to the lower electrode by different circuits, to precisely adjust the voltage Vcom and the voltage Vp, and to synchronize switching timings of the voltages Vcom and Vp. The lateral electric field system liquid crystal element can rapidly perform voltage inverting for each electrode and has higher response speed. Accordingly, there is almost no chance of occurrence of problems encountered in known techniques such that transmittance of the liquid crystal element gradually changes in a voltage transition period and occurrence of flickers. Further, even if the transmittance of the liquid crystal changes as time passes, since the change is very fast, such change is not nearly recognized by the eye and thus flickers are inhibited. Further, if it is assumed that the voltage supplied from the memory circuit is 0V when the reference power source voltage of the application voltage inverting circuit is the ground level, voltages applied to the electrodes of the liquid crystal becomes 0V and thus the short-circuited state is realized when a voltage is not applied to the liquid crystal. At this time, a direct current offset is not generated.

In the liquid crystal device, it is preferable that the application voltage inverting circuit includes a first switching element and a second switching element connected in series between a voltage supply terminal of the first voltage and the second voltage of the memory circuit and a ground power source potential and a third switching element and a fourth switching element connected in series between the voltage supply terminal of the first voltage and the second voltage of the memory circuit and the reference power source potential, in which a common node of the first switching element and the second switching element is connected to the first pixel electrode and a common node of the third switching element and the fourth switching element is connected to the second pixel electrode, and in which either both the first and fourth switching elements or both the second and third switching elements are controlled so as to be selectively turned on by a switching control signal.

This relates to the detailed circuit structure of the application voltage inverting circuit Two switching elements are connected in series between the voltage supply terminal of the memory circuit and the ground power source potential (generally, called ground). The two switching elements are set to be one pair. The application voltage inverting circuit includes two pairs of such switching elements and the two pairs are connected in parallel to each other. Further, common nodes of the pairs of two switching elements are electrically connected to the first pixel electrode and the second pixel electrode, respectively of the liquid crystal. Thus, when one switching element of one pair is turned on and the voltage from the memory circuit is supplied to the liquid crystal, one switching element of a remaining pair is turned on and the reference power source potential (ground) is supplied to the liquid crystal. In this way, when a remaining switching element of the remaining pair is turned on and the voltage from the memory circuit is supplied to the liquid crystal, the remaining switching element of the former pair is turned on and the reference power source potential (ground) is supplied to the lipid crystal. The synchronized switching control of the four switching elements can be easily achieved by using a switching control signal. For example, it is easy to control the switching elements so as for one switching element is turned on but a remaining switching element is simultaneously turned off by using complementary clock signals. Further, since the application voltage inverting circuit is composed of the least number of elements, it is possible to realize the most compact circuit that cannot be simplified anymore.

In the liquid crystal device, it is preferable that all of the first, the second, the third, and the fourth switching elements are the same conductive type transistors and the switching control signal is composed of reverse (complementary) clock signals.

This aspect clarifies that the switching elements are the same conductive type transistors (including MOS transistors and bipolar transistors) and switching on/off of the first to fourth transistors is controlled by the complementary clocks reverse to each other. The voltage supplied from the memory circuit is directly applied to sources or drains of the first to the fourth MOS transistors. However, there is no problem with a breakdown voltage because a breakdown voltage between a source and a drain of each of the MOS transistors is high. Further, since the memory circuit and the application voltage inverting circuit are directly coupled to each other (that is, there is no gate-to-source path of a MOS transistor out voltage supply paths to liquid crystal as disclosed in JP-A-2005-25048), values of power source voltages on a higher level side of the memory circuit and the application voltage inverting circuit may be equal to each other. Still further, since gate potentials of the four transistors, which constitutes the application voltage inverting circuit, are potentials supplied by external signals CLK and /CLK input from the outside of a pixel array, it is possible to supply an arbitrary voltage (for example, VDD+Vth) by which a voltage which is lower than the voltage VDD supplied from a SRAM by the voltage Vth due to voltage drop is be applied to the electrodes of the liquid crystal. In the technique disclosed in JP-A-2005-025048, since it needs to set a supply voltage from the SRAM to be VDD+Vth, each transistor constituting the SRAM must be a high breakdown voltage transistor. However, according to this aspect of the invention, the transistor constituting the SRAM may not be a high breakdown voltage transistor. Accordingly, the invention is superior to the known technique disclosed in JP-A-2005-25048 in the point that the voltage VDD can be applied to liquid crystal via the transistors of the application voltage inverting circuit without constituting the SRAM by the high breakdown voltage transistors. In this aspect of the Invention, even though the gates of the transistors of the application voltage inverting circuit are applied with a high voltage (VDD+Vth) by the use of the external clock signals CLK and /CLK, there is no problem with such structure because a gate breakdown characteristic is generally superior to a source/drain (S/D) breakdown characteristic of a transistor. In the case of configuring a transistor so as to have a high S/D breakdown voltage, there is a problem in that the transistor must have the overall structure adaptable to the high S/D breakdown voltage and thus sizes of the source and drain of the transistor must become larger. However, in the case of configuring the transistor so as to have a high gate breakdown voltage, such a transistor can be easily realized because the high gate breakdown voltage can be achieved by a simple manner of increasing a thickness of a gate Insulation film.

Further, since the four transistors of the application voltage inverting circuit have a function of transferring the voltage VDD or the ground potential GND to the liquid crystal, the size (width/length) of the transistor is not particularly limited but be free from limitation. However, it is desirable that relative sizes of the four transistors are considered and the relative sizes are set to be equal to each other when it comes to intend to set charging time and discharging time of a liquid crystal to be equal to each other. According to this aspect of the invention, it is possible prevent a device manufacturing process from getting complicated because there is no requirement that the transistors of the memory circuit and the transistors of the application voltage inverting circuit must be high breakdown voltage transistors. Further, since the complementary clock signals are versatile signals used in digital circuits, they can be easily generated.

In the liquid crystal device, it is preferable that voltage levels of the first control signal and the second control signal are set to be values which can sufficiently turn on the first transistor and the third transistor and thus the first voltage supplied from the memory circuit is applied to the first pixel electrode or the second pixel electrode of the liquid crystal element without voltage drop.

For example, it is assumed that 5V of the power source voltage VDD is supplied to the application voltage inverting circuit. If a voltage drop occurs across the application voltage inverting circuit, it happens that only a voltage which lower than 5V (VDD) is applied to the liquid crystal and thus voltage utilization efficiency is low. However, if the third MOS transistor and the third MOS transistor which play a role of supplying the voltage from the memory circuit to the liquid crystal are fully turned on, no problem in association with voltage drop occurs because the voltage 5V (=VDD) from the memory circuit is fully supplied to the liquid crystal. This is realized in the case in which gates of the first NMOs transistor and the third NMOS transistor are driven by the control signals having a voltage level which is equal to or higher than the sum of 5V(VDD)+threshold voltage (Vth) when it is assumed that the first and the fourth transistors are NMOS transistors. The voltage higher than VDD can be obtained by boosting the power source voltage using a boot strap circuit in a simple manner. Accordingly, there is no problem with realization of such as a gate driving method of the NMOS transistor.

In the liquid crystal device, It is preferable that the application voltage inverting circuit further includes a switching element which blocks voltage supply from the memory circuit at a timing when a voltage level of the switching control signal changes.

In the middle of performing switching on/off of the two transistors connected in series in the application voltage inverting circuit, it can happen that both the two transistors are simultaneously turn on and thus a penetrating current flows at this time. Accordingly, the switching element is turned off at a timing when the penetrating current flows, thereby blocking voltage supply (current supply) from the memory circuit. That is, the switching element is provided in order to securely preventing the penetrating current from flowing.

In the liquid crystal device, it is preferable that the liquid crystal device is a digital driving system liquid crystal device in which gradation is weighted by a pulse width modulation (PWM) driving method. The reverse clock signals can be obtained on the basis of timing pulses used for the digital driving.

In the digital driving system of a liquid crystal (which is a PWM driving system and also is called a sub-field driving system because one frame is divided into a plurality of sub-fields and on/off control of the liquid crystal is performed in every sub-field), since on/off of the liquid crystal is determined in every sub-field, timing pulses must be generated using a timing circuit. The control signal (complementary clock signals) supplied to the application voltage inverting circuit can be easily generated in a simple manner by directly using the timing pulses or modulating the timing pulses by frequency dividing or frequency multiplying. Accordingly, according to the invention, it does not need to use an additional special circuit in order to generate the control signal. Thus, it is possible to simplify a circuit structure (system structure).

In the liquid crystal device, it is preferable that the reference power source potentials of the memory circuit and the application voltage inverting circuit are supplied via the common power source wiring in the pixel circuit.

When causing a short-circuit between both the electrodes of the liquid crystal, the voltage (for example, 0V) supplied from the memory circuit is supplied to one electrode of the electrodes of the liquid crystal and the reference power source potential (for example, 0V) of the application voltage inverting circuit is supplied to a remaining electrode of the electrodes of the liquid crystal. At this time, if the ground wiring of the memory circuit and the ground wiring of the application voltage inverting circuit are common in the pixel circuit, even if the voltage level (0V) fluctuates due to in-plane irregularity of distribution of liquid crystals, since the potentials of the electrodes fluctuate together in the same manner, there is no relational potential difference between voltage levels applied to both the electrodes of the liquid crystal. Accordingly, in the case in which the liquid crystal is not applied with a voltage, the short-circuited state of the electrodes can be realized with high precision and a direct current offset is not generated. As a result, image sticking may not occur.

In the liquid crystal device, it is preferable that the memory circuit holds one bit of data.

In the liquid crystal device, it is preferable that an SRAM cell is a high resistance type SRAM cell in which loads of a flip-flop circuit are formed of resistors with high resistance (for example, resistors formed by ion implantation), a full CMOS type cell in which all elements including loads are formed of MOS transistors, or a latch type cell in which the flip-flop circuit is constructed using a plurality of inverters.

In the liquid crystal device, it is preferable that the lateral electric field system liquid crystal element is an IPS system liquid crystal element.

In the liquid crystal device, it is preferable that the lateral electric field system liquid crystal is an IPS system liquid crystal which is once used.

In the liquid crystal device, the liquid crystal device is a reflective type liquid crystal device and the memory circuit and the application voltage inverting circuit are disposed in an element formation region under the first pixel electrode and the second pixel electrode which are made of a light reflective material.

Widen the liquid crystal device is a reflective type liquid crystal device, it is possible to dispose the element formation region to under the pixel electrodes. Since the application voltage inverting circuit has a simple structure, it is not difficult to arrange the memory circuit and the application voltage inverting circuit in an empty space under the pixel electrodes. Accordingly, it is possible to form the pixel circuit according to the invention without increasing an occupation area of the pixel circuit.

In the liquid crystal device, the application voltage inverting circuit inverts the voltages of the first electrode and the second electrode of the liquid crystal at a predetermined timing when an image is displayed on the liquid crystal element.

The timing at which the application voltages of the liquid crystal are inverted is suitably determined depending on the characteristic of the liquid crystal which is used. In order to prevent the image sticking from occurring, it is desirable that voltage polarities applied to the electrodes of the liquid crystal are inverted for every frame or in an interval of several frames.

A second aspect of the invention provides an active matrix substrate including a first pixel electrode and a second electrode which apply an electric field to a liquid crystal layer of a lateral electric field system liquid crystal element, a memory circuit which is disposed in a pixel circuit and which serves as a voltage sources of a first voltage and a second voltage, and an application voltage inverting circuit which is disposed in the pixel circuit and which inverts the voltages applied to the liquid crystal element by controlling each of the first voltage and the second voltage so as to be supplied to either the first pixel electrode or the second pixel electrode.

This aspect clarifies the structure of the active matrix substrate before a liquid crystal layer is provided thereto.

A third aspect of the invention provides an electronic apparatus including the liquid crystal device according to the first aspect.

The liquid crystal device can be mounted on an electronic apparatus, such as a sub-panel of a cellular phone, a low power notebook computer, and a reflective type projector. According to the invention, it is possible to inhibit flickers of a still image which is attributable to voltage inverting, and thus it is possible to display a high quality image. Further, since the direct current offset is negligibly generated, there is almost no temporal deterioration of picture quality of a display image.

According to the invention, it is possible to realize application voltage inversion with high precision while inhibiting the flickers using a simple circuit structure and a simple control method. Further, it is possible to realize the short-circuited state of electrodes, in which a direct current offset is not generated in the case in which a voltage is not applied to a liquid crystal.

BRIEF DESCRIPTION OF THE DRAWINGS

The invention will be described with reference to the accompanying drawings, wherein like numbers reference like elements.

FIGS. 5A and 5B are timing diagrams illustrating operation of the pixel circuit shown in FIG. 3, in which FIG. 5A is a timing diagram illustrating operation of the memory circuit and FIG. 5B is a timing diagram illustrating operation of the application voltage inverting circuit.

FIGS. 9A to 9C are views for explaining a circuit structure and operation of the application voltage inverting circuit having a unit which suppresses a penetrating current (Ipeak), in which FIG. 9A is a circuit diagram illustrating the circuit structure, FIG. 9B is a timing diagram illustrating operation of the circuit shown in FIG. 9A, and FIG. 9C is a timing diagram illustrating operation of a comparative circuit which does not have a unit which suppresses a penetrating current.

DESCRIPTION OF EXEMPLARY EMBODIMENTS

Hereinafter embodiments of the invention will be described with reference to the accompanying drawings.

First Embodiment

First, a basic structure of one pixel will be described.

Basic Structure of One Pixel

Figure 1:
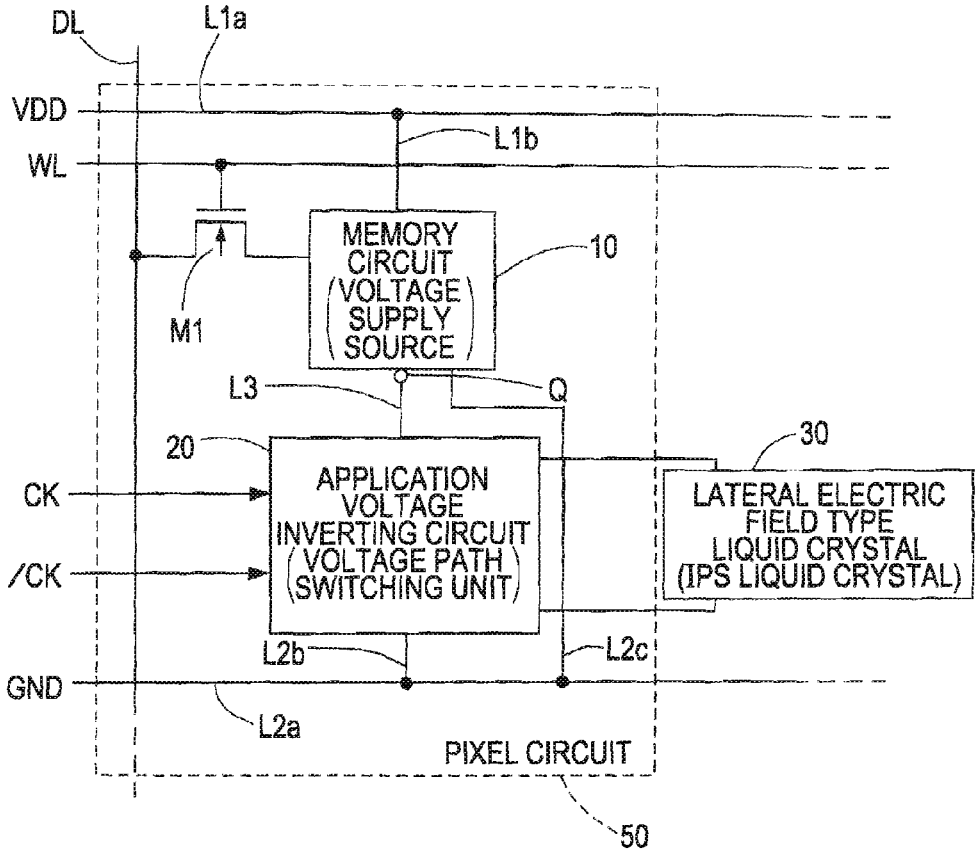
FIG. 1 is a schematic block diagram illustrating one pixel of a liquid crystal device according to one embodiment.

FIG. 1 shows a structure of one pixel in a liquid crystal device according to one embodiment of the invention. As shown in FIG. 1, one pixel includes a pixel circuit 50 and a lateral electric field system liquid crystal (herein, called IPS liquid crystal but not limited thereto) 30.

The lateral electric field system liquid crystal is a liquid crystal having a system in which alignment control of liquid crystal molecules is achieved by applying an electric field parallel to a substrate surface to a liquid crystal layer. This system is called In-Plane Switching (IPS) system or Fringe-Field Switching (FFS) system according to the shape of electrodes by which an electric field is applied to a liquid crystal. The lateral electric field system liquid crystal has a structure in which two electrodes corresponding to one pixel are provided on either one of two substrates having liquid crystals therebetween and has small load capacity in comparison with a TN liquid crystal in which all pixels share one common electrode LCcom). That is, load capacity of each pixel of the lateral electric field liquid crystal corresponds to a capacity of one pixel. Accordingly, when inverting voltages applied to the liquid crystal, it is possible to rapidly change voltages of all the electrodes. The invention is based on such a characteristic of the lateral electric field liquid crystal, and the invention positively employs the lateral electric field liquid crystal in order to rapidly change voltages applied to electrodes of the liquid crystal with decreased load capacity.

A structure of the IPS liquid crystal device will be described with reference to FIGS. 7 and 8. As shown in FIG. 8, in the IPS liquid crystal device, a first pixel electrode 218*a* and a second pixel electrode 218*b* (both made of a light reflective material) are disposed close to each other on the same substrate and an electric field E is applied in a direction parallel to a plane of the substrate.

The pixel circuit 50 includes a pixel selecting transistor (NMOS transistor) M1 with a gate connected to a scan line WL and an end (source or drain) connected to a data line DL, a memory circuit 10 functioning as a voltage supply source, and an application voltage inverting circuit (voltage path switching circuit) 20 which inverts polarities of voltages applied to electrodes of a liquid crystal.

The memory circuit 10 is operated between a higher level power source voltage (VDD:5V) supplied via a first power source wiring L1*a* and a ground potential (GND) supplied via a second power source wiring L2*a*. The memory circuit 10 receives two voltage values (for example, a first voltage: VDD(5V) and a second voltage: GND(0V)) corresponding to black and white, respectively, and supplied via the data line DL. The memory circuit 10 operates so as to supply the voltage VDD or the voltage GND which is input thereto to the application voltage inverting circuit 20 as a power source voltage but does not involve in an operation of inverting voltages applied to the liquid crystal.

The application voltage inverting circuit (voltage path switching unit) 20 is connected between a voltage supply terminal Q of the memory circuit 10 and the reference power source potential GND. The application voltage inverting circuit 20 is driven by the voltage VDD (5V) supplied from the memory circuit 10 as a higher level power source voltage. The lower level power source voltage GND is supplied to the application voltage inverting circuit 20 via the second power source wiring L2*a*. Complementary clock signals (switching control signals for switching voltage paths) CK and /CK having reversed potentials to each other are transmitted to the application voltage converting circuit 20 and a voltage supply path to be connected to the liquid crystal is switched at a timing when the complementary clock signals CK and /CK are inverted.

in FIG. 1, reference L1*b* denotes a wiring which transfers a power source potential VDD of the first power source wiring L1*a* to the memory circuit 10, and reference L1*b* denotes a wiring which transfers a power source potential GND of the second power source wiring L2*a* to the application voltage inverting circuit 20. Further, reference L2*c* denotes a wiring which transfers the power source potential GND of the second power source wiring L2*a* to the memory circuit 10, Reference L3 denotes a wiring which transfers two voltages BEND and GND output from the voltage supply terminal Q of the memory circuit 10 to the application voltage inverting circuit 20.

A ground wiring which supplies a ground potential to the memory circuit 10 and a ground wiring which supplies a ground potential to the application voltage inverting circuit 20 are a common wiring in the pixel circuit 50. That is, the ground wirings L2*a*, L2*b*, and L2*c* are realized by one ground wiring (that is, the ground wirings L2*a*, L2*b*, and L2*c* are not realized by individual wirings). Accordingly, the ground potential 0V supplied from the memory circuit 10 and the ground potential 0V which is the reference power source potential GND of the application voltage inverting circuit 20 are the same potential, and thus there is no potential difference between them. That is, if one of them varies, the other one also varies, so that no potential difference is created between them. This means that a direct current offset is not created when the liquid crystal 30 is in the short-circuited state, which is achieved when 0V output from the application voltage inverting circuit 20 is applied to electrodes of the liquid crystal 30.

Exemplary Structure of a Memory Cell

Figure 2A:
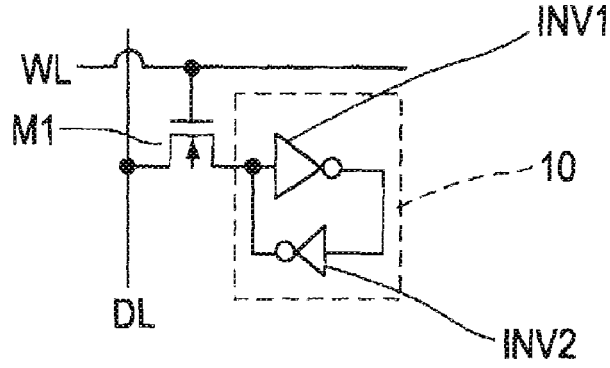
FIGS. 2A to 2C are circuit diagrams illustrating exemplary circuit structures of a memory circuit (memory cell) 10 shown in FIG. 1.

FIGS. 2A to 204 show an exemplary circuit structure of a memory circuit (memory cell) 10 shown in FIG. 1. Each is a static random access memory (SRAM) type memory cell.

A memory cell (latch-type memory cell) of FIG. 2A has a flip-flop structure which includes an inverter INV1 having a high driving ability and an inverter INV2 having a low driving ability, thereby maintaining a bit of data.

Figure 2B:
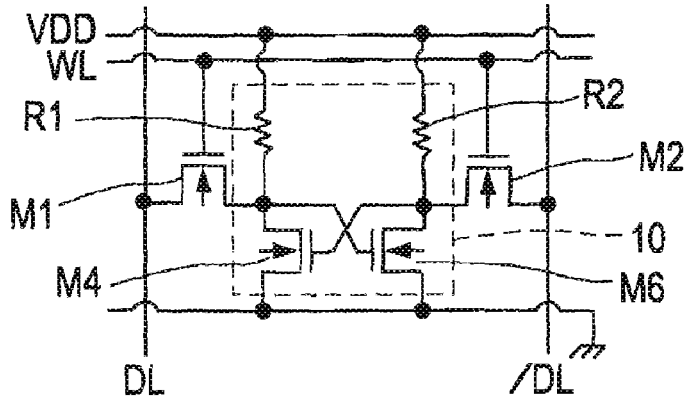

The memory cell (high resistance type memory cell) shown in FIG. 2B is composed of two transfer transistors (NMOS transistors acting as pixel selection transistors) M1 and M2, NMOS transistors M4 and M6 forming a flip-flip circuit, and load resistors R1 and R2. The data line is composed of two data lines DL and /DL which supply complimentary signals.

Figure 2C:
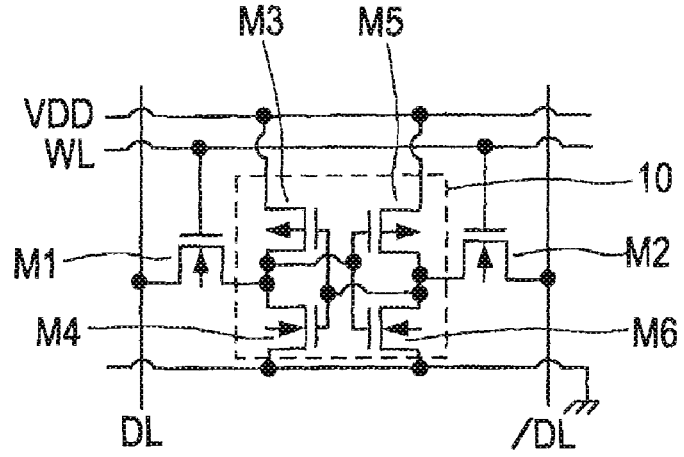

The memory cell shown in FIG. 2C has a full CMOS structure. The structure of the memory cell shown in FIG. 2C is basically the same as the structure of the memory cell shown in FIG. 2B. However, load of the flip-flop circuit includes PMOS transistors M3 and M5. The data line is comprised of two data lines DL and /DL which supplies complementary signals.

Structure of a Pixel Circuit

Figure 3:
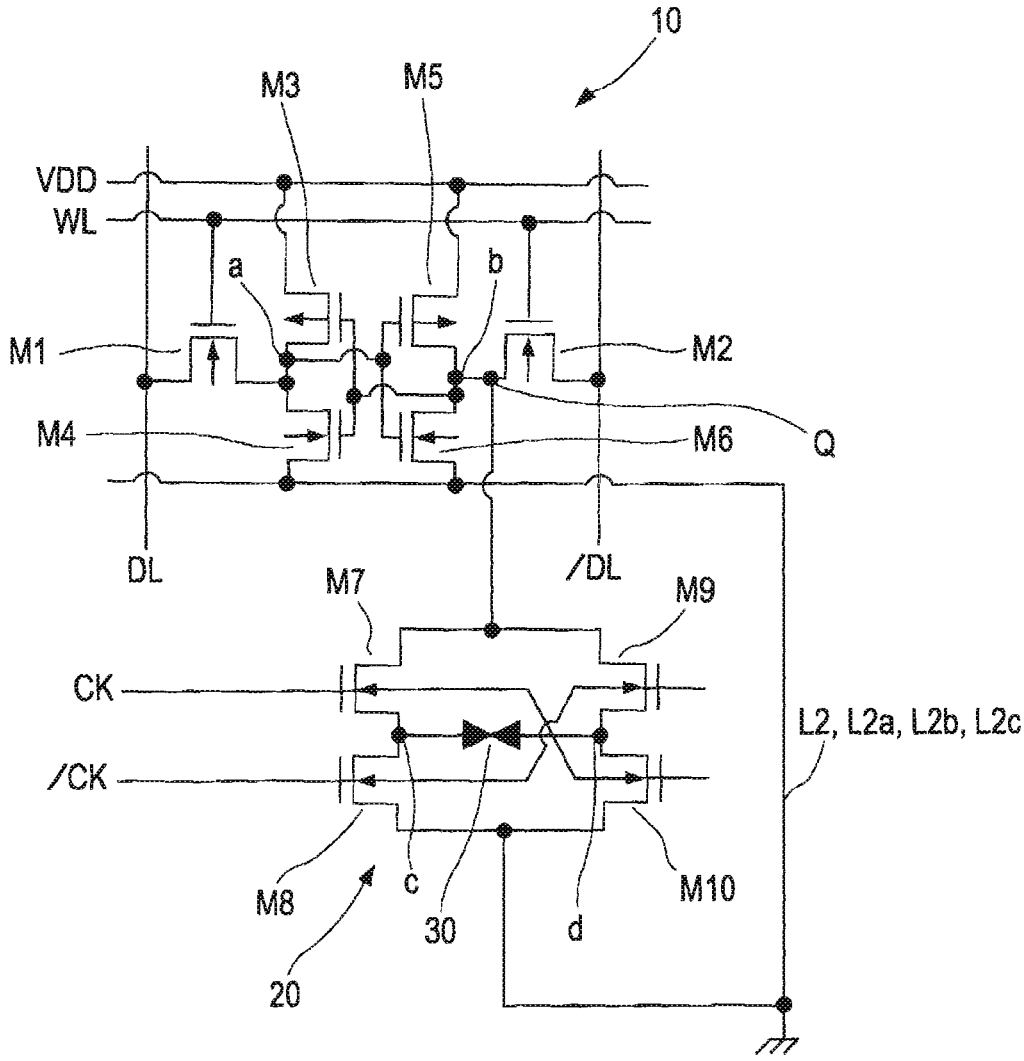
FIG. 3 is a circuit diagram illustrating a detailed circuit structure of a pixel circuit 50.

FIG. 3 shows a basic circuit structure of the pixel circuit 50. In FIG. 3, the memory circuit 10 has a full CMOS structure shown in FIG. 2C.

The application voltage inverting circuit 20 includes two NMOS transistors M7 and M8 acting as a first switching element and a second switching element which are connected in series between the voltage supply terminal Q of the memory circuit 10 and the reference power source potential GND and further includes NMOS transistors M9 and M10 acting as a third switching element and a fourth switching element connected in series between the voltage supply terminal Q of the memory circuit 10 and the reference power source potential GND.

A common node c of the NMOS transistors M7 and M8 serving as the first and the second switching element and a common node d of the NMOS transistors M9 and MIO serving as the third and the fourth switching element are connected to a first electrode and a second electrode (218*a* and 218*b* in FIG. 8), respectively, of the lateral electric field system liquid crystal (IPS liquid crystal element) 30.

The clock signal CK is input to gates of the NMOS transistors M7 and M10 serving as the first switching element and the fourth switching element as a switching control signal and thus the NMOS transistors M7 and M10 are simultaneously turned on or off by the clock signal CK.

In the same manner, the counter clock signal /CK is input to gates of the NMOS transistors M8 and M9 serving as the second switching element and the third switching element as a switching control signal and thus the NMOS transistors M8 and M9 are simultaneously turned on or off by the clock signal /CK.

That is, the NMOS transistors M7 and M8 are a pair of transistors connected in series between the voltage supply terminal Q of the memory circuit 10 and the reference power source potential GND. In the same manner, the NMOS transistors M9 and M10 serving as the third transistor and the fourth transistor are a pair of transistors connected in series between the voltage supply terminal Q of the memory circuit 10 and the reference power source potential GND. On the other hand, the pair of transistors M7 and M8 and the pair of transistors M9 and M10 are connected in parallel with each other between the voltage supply terminal Q of the memory circuit 10 and the reference power source potential &ND. The nodes c and d of the pairs of NMOS transistors are electrically connected to the first pixel electrode and the second pixel electrode (218*a* and 218*b* in FIG. 8) of the liquid crystal element 30.

Thus, when either one transistor of either one pair of transistors (herein, the first NMOS transistors M7) is turned on and thus a voltage from the memory circuit 10 is supplied to either one (218*a* in FIG. 8) of electrodes of the liquid crystal element 30, one ADIOS transistor of a remaining pair of NMOS transistors (herein, the fourth NMOS transistor M10) is turned on and thus the reference power source potential (ground) is supplied to a remaining electrode (218*b* in FIG. 8) of the electrodes of the liquid crystal element 30.

In the same manner, when a remaining transistor of the remaining pair of AMOS transistors (i.e. the third NMOS transistor M9) is turned on and thus the voltage from the memory circuit 10 is supplied to one electrode (218*a* in FIG. 8) of the electrodes of the liquid crystal element 30, a remaining NMOS transistor (i.e. the second transistor M8) of one pair of NMOS transistors is turned on and thus the reference power source potential (ground) is supplied to the remaining electrode (218*b* in FIG. 8) of the electrodes of the liquid crystal element 30.

As described above, the ground potential of the memory circuit 10*k* and the ground potential of the application voltage inverting circuit 20 are supplied via the common ground wiring (L2, particularly L2*a*, L2*b*, and L2*c*). Accordingly, when the ground potentials are supplied to the electrodes 218*a* and 218*b* of the liquid crystal element 30, there is no difference in voltage levels of the electrodes and no direct current offset is generated. Accordingly, there is no change of occurrence of image sticking.

In the circuit shown in FIG. 3, the voltage supplied form the memory circuit 10 is directly applied to an end (source or drain) of upper side NMOS transistors M7 and M9 constituting the application voltage inverting circuit 20. Generally, a breakdown voltage between the source and the drain of the NMOS transistor is higher than a breakdown voltage between the gate and the source, and thus there is no particular problem in association with the breakdown voltage.

In the case of the pixel circuit of FIG. 3, the memory circuit 10 and the application voltage inverting circuit 20 are directly connected to each other. For example, the memory circuit 10 and the application voltage inverting circuit 20 are not connected in such a manner that a path between the gate and the source of the MOS transistor exists on the voltage supply path to the liquid crystal as disclosed in JP-A-2005-025048. Accordingly, values of higher level power source voltages (VDD) of the memory circuit 10 and the application voltage inverting circuit 20 may be set to be equal to each other (i.e. both VDD=5V). Further, it is possible to set sizes of the MOS transistors M1 to M10 of the memory circuit 10 and the application voltage inverting circuit 2*u* to be equal to each other. For example, each of the transistors M1 to M5 of the memory circuit 10 must be a high breakdown voltage transistor.

The complementary clock signals OK and /CK are versatile signals in digital circuits and can be easily generated. In particular, it is easy to obtain complementary clock signals CK and /CK on the basis of timing pulses used in a digital gradation driving method using pulse width modulation (PWM).

In the pixel circuit shown in FIG. 3, it is desirable that the voltage VDD (5V) supplied from the memory circuit 10 directly becomes a higher level power source voltage of the application voltage inverting circuit 20 and thus the voltage VDD (5V) is directly supplied to one electrode (218*a* in FIG. 8) of the liquid crystal element 30 from the viewpoint of utilization efficiency of a voltage. However, such a goal is achieved under the condition in which no voltage drop occurs between a source and a drain of the NMOS transistor M7 or M9. To this end, a gate voltage which can fully turn on the first NMOS transistor M7 and the third NMOS transistor M9 may be supplied to the gates of the NMOS transistors M7 and M9.

In greater detail, the gates of the first NMOS transistor M7 and the third NMOS transistor M9 may be driven by the control signal CK or /CK having a voltage level higher than a voltage (the sum of 5V (VDD)+a threshold voltage (Vth)). Further, it is not difficult to raise the voltage level of the clock signal CK or /CR to a voltage higher than the voltage VDD. For example, since it is possible to easily obtain such a voltage higher than the voltage VDD by boosting up the power source voltage VDD by using a boot strap circuit, it is not difficult to realize such a gate driving method of the NMOS transistor.

Basic Operation of an Application Voltage Inverting Circuit

Figure 4A:
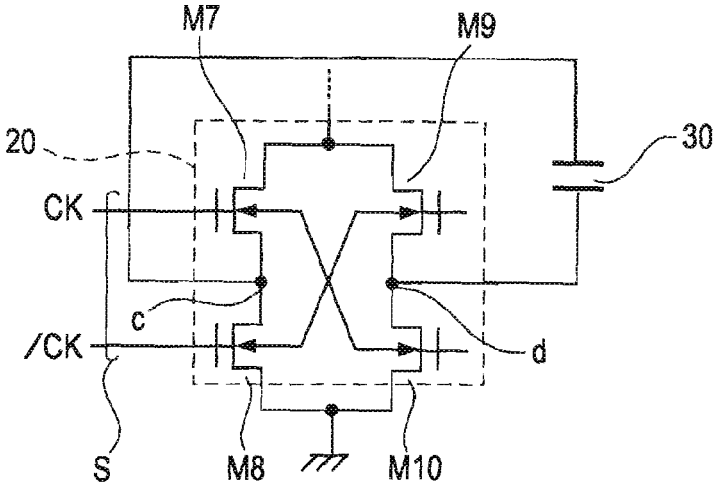
FIGS. 4A to 4C are explanatory views for explaining voltage polarity inverting operation performed by an application voltage inverting circuit which inverts a polarity of a voltage applied to a liquid crystal.
Figure 4B:
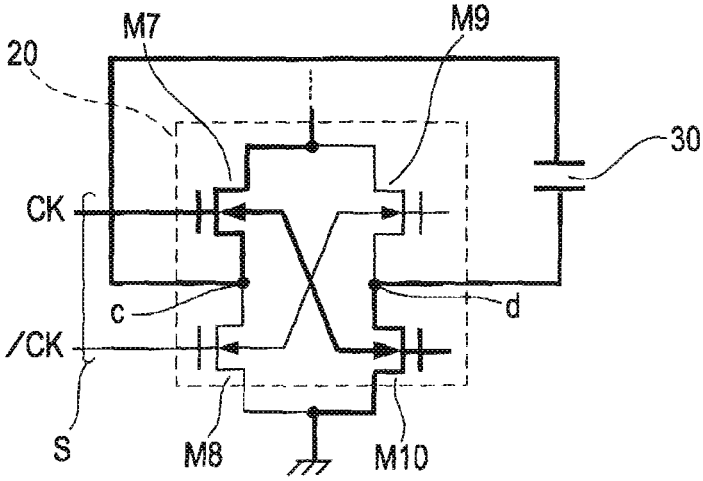
Figure 4C:
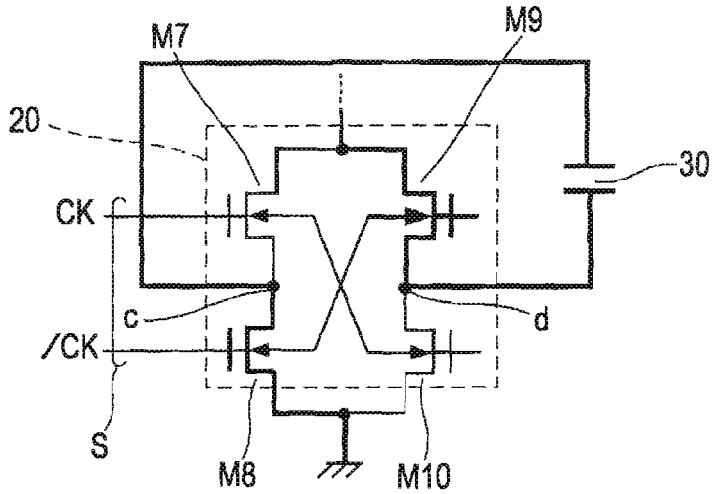

FIGS. 4A to 4C are explanatory views for explaining polarity inverting operation of a voltage applied to the liquid crystal by using the application voltage inverting circuit. In FIG. 4, for conveniences sake, the limpid crystal element 30 is shown like a capacitor.

FIG. 4A shows the state in which the application voltage inverting circuit 20 is connected to the liquid crystal element 30. In FIG. 4B, the first NMOS transistor M7 and the fourth NMOS transistor M10 are turned on and a voltage is applied to the electrodes of the liquid crystal element 30 along the path indicated by a heavy line. In FIG. 4C, the second NMOS transistor M8 and the third NMOS transistor M9 are turned on and a voltage is applied to the electrodes of the liquid crystal element 30 along the path indicated by a heavy line.

In the sate shown in FIG. 4B, the voltage from the memory circuit 10 is applied to an upper electrode of the liquid crystal element 30 and the reference power source potential GND is applied to a lower electrode of the liquid crystal element 30. On the other hand, in the state shown in FIG. 4C, the voltage supplied from the memory circuit 10 is applied to the lower electrode of the liquid crystal element 30 and the reference power source potential GND is applied to the upper electrode of the liquid crystal element 30. In this manner, the voltages applied to the liquid crystal element 30 can be rapidly changed by switching the voltage application paths.

As apparent from FIGS. 4B and 4C, the voltage applying paths are switched but the voltage sources of the voltages applied to the liquid crystal element 30 are not changed. That is, the voltages applied to the liquid crystal element 30 are the voltage supplied from the memory circuit 10 and the reference power source potential GND of the application voltage inverting circuit 20, respectively and this point is in common in the states shown in FIGS. 4A and 4B. Accordingly, the voltage value does not vary before and after the voltage polarity inverting operation, the voltage polarity inversion is securely performed with high precision, and the voltage inverting operation can be performed in a simple manner.

In the circuit of the invention, the complicated control performed in the known techniques is not needed. For example, by the use of the circuit of the invention, it does not need to perform the operation which individually controls the voltages Vp and Vcom of the lower electrode and the counter electrode (common electrode) and the operation which synchronizes the application timings of the voltages.

Figure 5A:
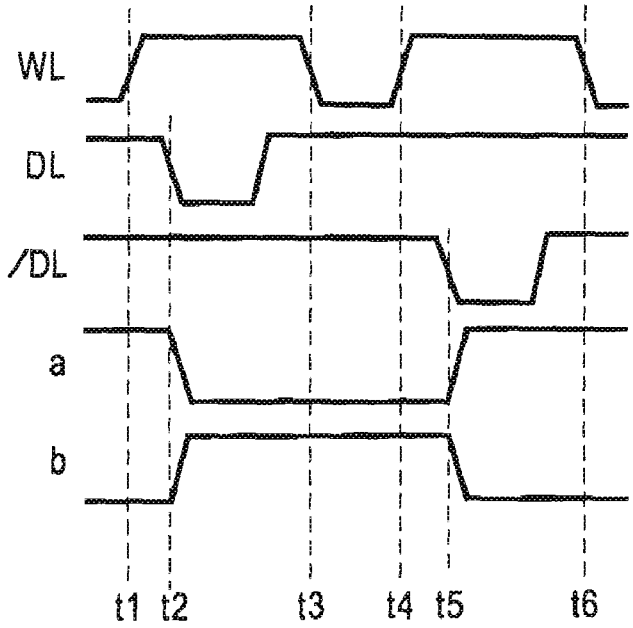
Figure 5B:
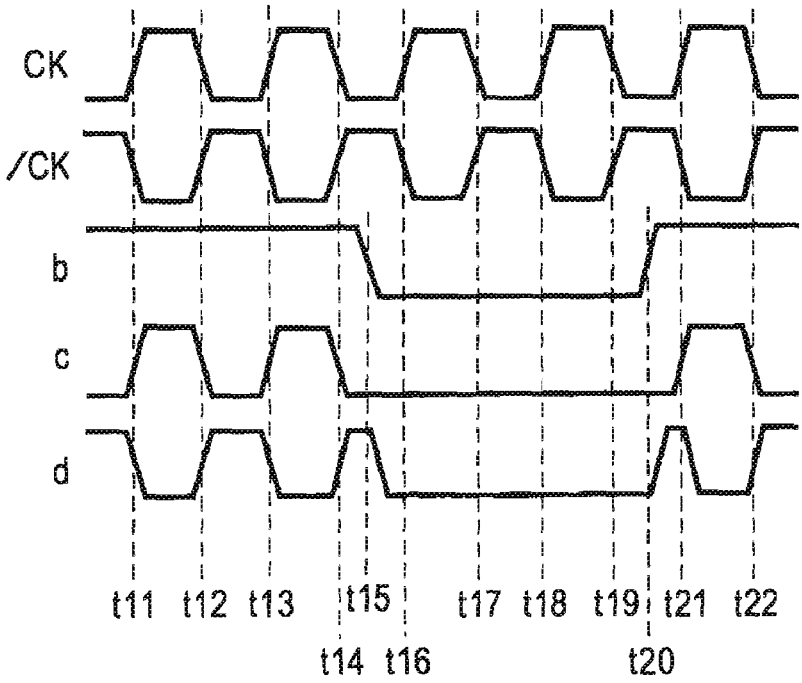

Operation Details of a Memory Circuit and an Application Voltage Inverting Circuit FIGS. 5A and 5B show timing diagrams illustrating operation timings of the pixel circuit shown in FIG. 3. FIG. 5A is a timing diagram illustrating the operation of the memory circuit and FIG. 5B is a timing diagram illustrating the operation of the application voltage inverting circuit.

First, the operation of the memory circuit 10 will be described with reference to FIG. 5A. The scan line WL changes from a low level to a high level at a time t1, and the data line DL changes from a high level to a low level in electric potential at a time t2. On the basis of the voltage levels and the potential levels of the scan line WL and the data line DL, a voltage at a point "a" in FIG. 3 (an output point of the SRAM) changes from a high level to a lower level and a voltage at a point "b" (another output point of the SRAM, which functions as the voltage supply terminal Q of the memory circuit) changes from a low level to a high level.

The scan line WL becomes a low level at a time t3 and becomes a high level at a time t4. The data line /DL changes from a high level to a low level in electric potential at a time t5. On the basis of the voltage levels and the potential levels of the scan line WL and the data line /DL, a voltage at the point 'a' in FIG. 3 (output point of the SRAM) changes from a low level to a high level and a voltage at the point "b" (another output point of the SRAM which functions as a voltage supply point of the memory circuit) changes from a high level to a low level.

Next, the operation of the application voltage inverting circuit 20 will be explained. As shown in FIG. 5B, voltage levels of the complementary clock signals CK and /CK are periodically inverted. During each period of periods from t11 to t12, from t13 to t14, from t16 to t17, from t18 to t19, and from t21 to t21 in which the clock signal CK is in a high level, a voltage is applied to the liquid crystal element along the path indicated by a heavy line shown in FIG. 4B. In these periods, a potential at a point "c" becomes equal to a potential at the point "b" (i.e. voltage supply terminal Q of the memory circuit 10), and a potential at a point "d" becomes equal to the reference power source potential GND (ground potential).

On the other hand, during each period of periods from t12 to t13, from t14 to t16, from t17 to t18, and from t19 to t21 in which the clock signal /CK is in a high level, a voltage is applied to the liquid crystal element 30 along the path indicated by a heavy line shown in FIG. 4C. In these periods, a potential at the point "d" becomes equal to a potential at the point "b" (i.e. voltage supply terminal Q of the memory circuit 10), and a potential at a point "c" becomes equal to the reference power source potential GND (ground potential).

With reference to FIG. 5B, a potential at the point "b" (i.e. voltage supply terminal Q of the memory circuit 10) changes from a high level to a low level at a time 15 and changes from a low level to a high level at a time t20.

In this manner, potentials at the points "c" and "d" are determined by the voltage levels of the complementary clock signals CK and /CK and the voltage level at the point "b" at that time, and thus the potentials at the points "c" and "d" change as shown in FIG. 5B.

Overall Structure of a Liquid Crystal Device

Figure 6:
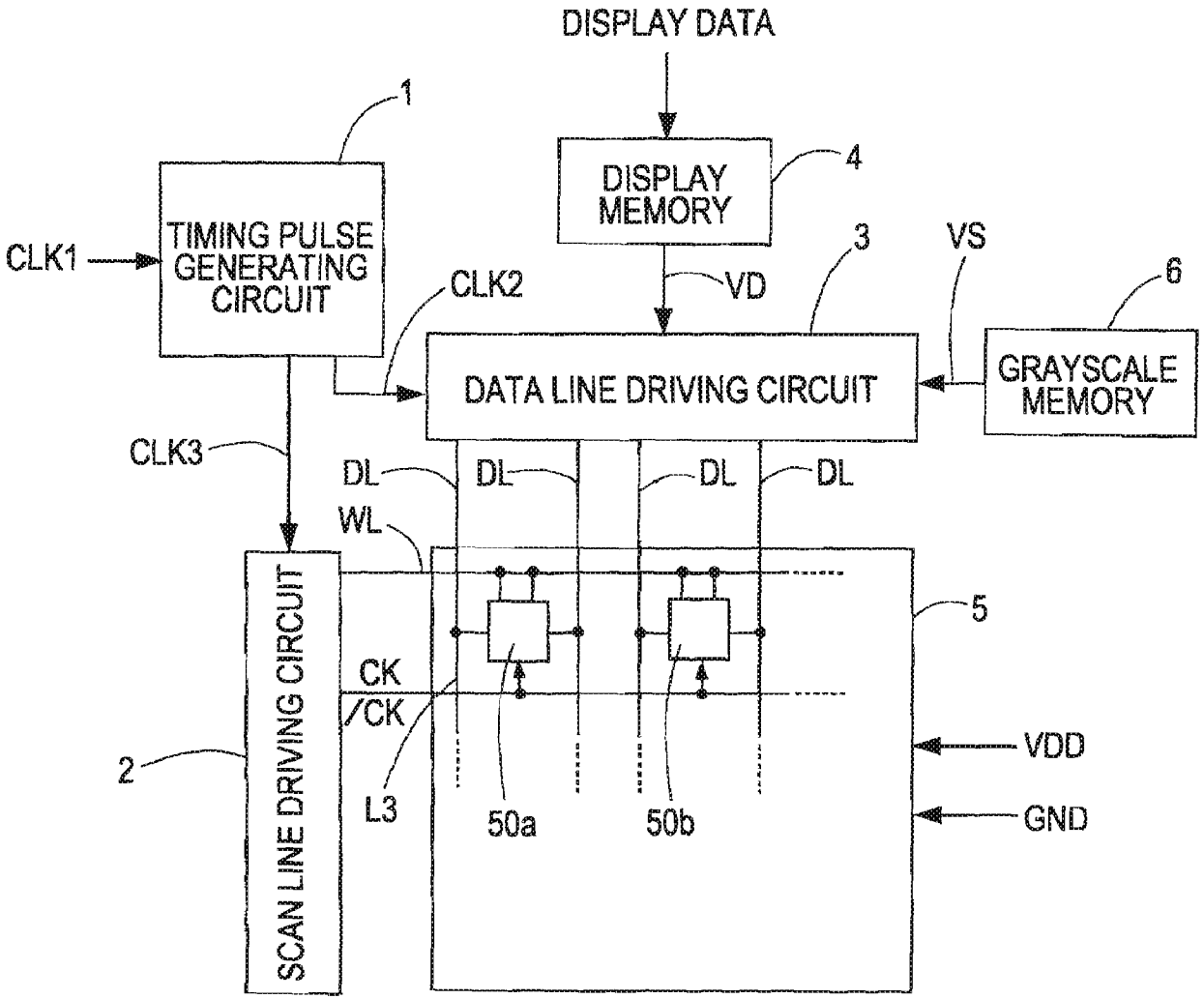
FIG. 6 is a block diagram illustrating an overall structure of the liquid crystal device according to the invention.

FIG. 6 is a block diagram illustrating an example of an overall structure of a liquid crystal device according to the invention. In the liquid crystal device shown in FIG. 6, a sub-field driving method is used as a digital gradation driving system. That is, a period of one field is equally divided into sub-fields and on/off control of the liquid crystal element 20 is performed for every sub-field. However, the invention is not limited thereto.

The liquid crystal device shown in FIG. 6 displays 256 shades of gray by a driving method using PWM. The total number of pixels is 1024×768 and the number of pixels on each line, which can be sent as data at a time, is 128. A display panel is driven in each of every sub-field, each having the same interval.

As shotgun in FIG. 6, the liquid crystal device includes a timing pulse generating circuit 1, a scan line driving circuit 2, a data line driving circuit 3, a display memory 4, an image display region 5 including a plurality of pixel circuits 50*a*, 50*b*, . . . , and a grayscale memory 6.

The timing pulse generating circuit 1 generates timing pulses CLK2 and CLK3, such as a horizontal synchronizing signal, a vertical synchronizing signal, a sub-field timing pulse, and a scan line driving pulse on the basis of a basic clock pulse CLK1, and sends such timing pulses to the scan line driving circuit 2 and the data line driving circuit 3.

The scan line driving circuit 2 sequentially loads a high (H) level to scan lines WL at timings of scan line driving pulses. The scan line driving circuit 2 outputs complementary clock signals CK and /CK to the application voltage inverting circuits 20 included in the pixel circuits 50*a*, 50*b*, . . . , respectively.

The display memory 4 is a memory temporarily storing display data which is externally supplied, includes the same number of memory slots as the number of pixels in the image display region 5, and stores display data by an amount corresponding to one field at a time. The display data is grayscale data consisted of 8 bits, which exhibits one gray shade of display brightness and has values from 0 to 255. For example, the value 0 of the display data means black and white and the value 255 of the display data means white. The display data VD output from the display memory 4 is supplied to the data driving circuit 3.

The grayscale memory 6 is a memory preliminarily storing numbers given to sub-fields corresponding to the display data, and the numbers given the sub-fields corresponding to every display data are stored in the grayscale memory 6. The data VS output from the grayscale memory 6 is supplied to the data driving circuit 6.

The data driving circuit 3 reads out the display data VD from the display memory 4 with respect to each scan line and exchanges the display data VD, which is read out, with the numbers given to the sub-fields on the basis of the contents of the grayscale memory 6. Thus, each pixel is driven on the basis of the scan line driving pulse, the sub-field timing pulse and the numbers given to sub-fields.

The clock signals CK and /CK supplied to application voltage inverting circuits 20 included in the corresponding pixel circuits 50*a*, 50*b*, . . . can be simply generated on the basis of the timing pulses CLK2 and CLK3 output from the timing pulse generating circuit 1. That is, the clock signals CK and /CK are generated by directly using the timing pulses CLK2 and CLK3 or by modulating the timing pulses CLK2 and CLK3 in a manner of frequency dividing or frequency multiplying. Accordingly, in the liquid crystal device shown in FIG. 6, it does not need to use an additional (special) circuit which generates the control signals CK and /CK. Accordingly, it is possible to simplify the circuit structure (system structure) of the liquid crystal device.

Device Structure of a Lateral Electric Field System Liquid Crystal Device

Figure 7:
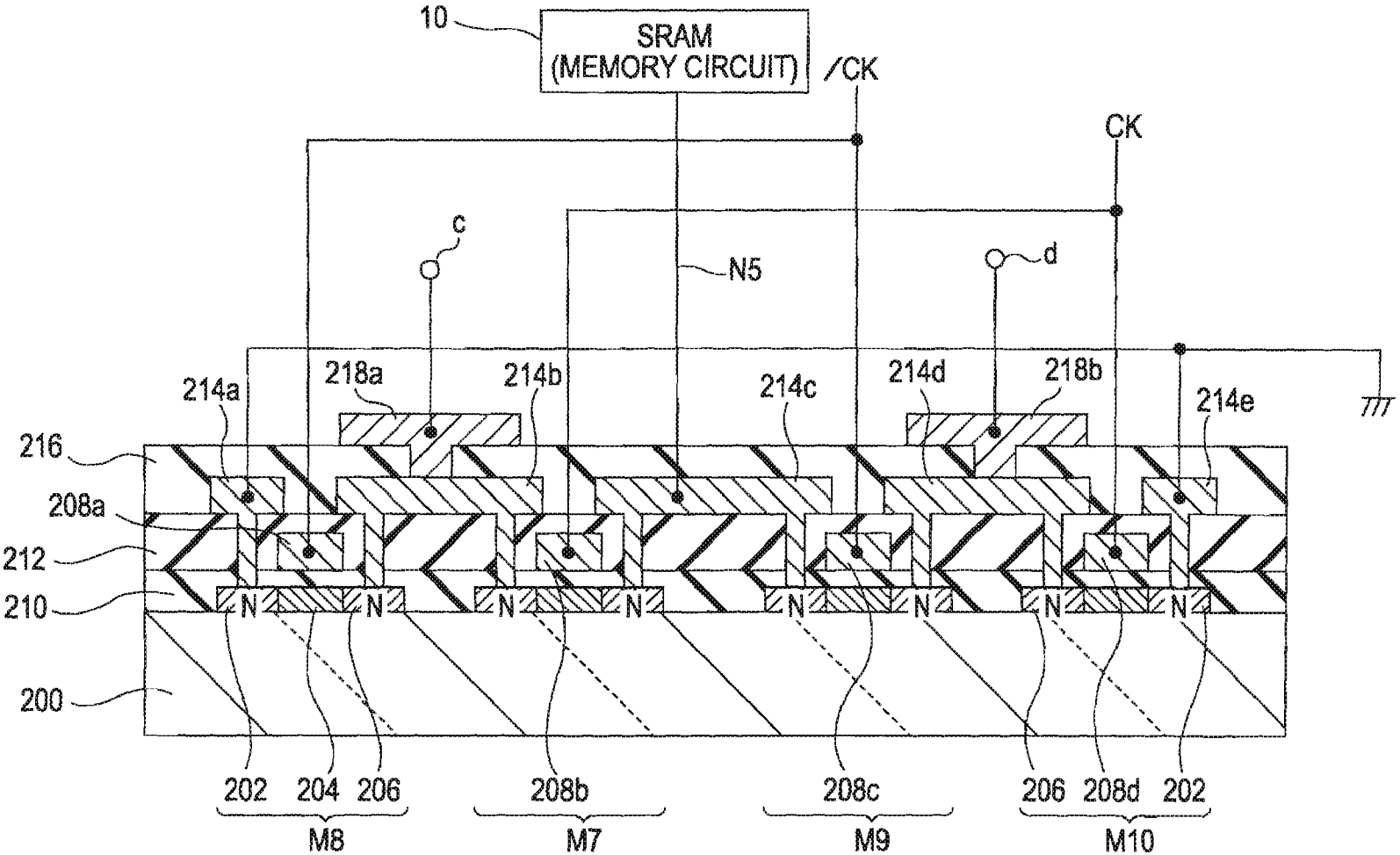
FIG. 7 is a sectional view illustrating main part of an active matrix substrate according to the invention.
Figure 8:
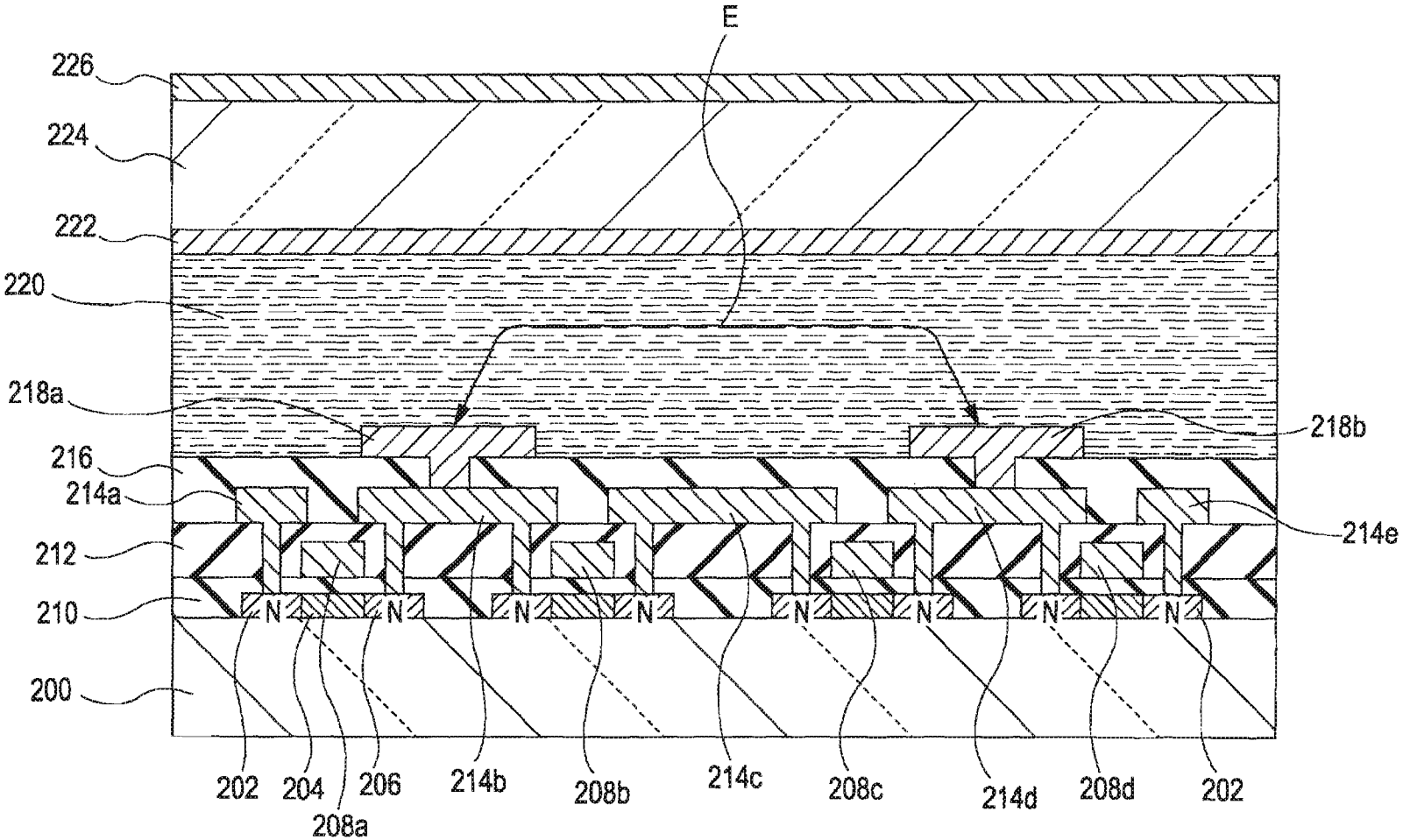
FIG. 8 is a sectional view illustrating the liquid crystal device (lateral electric field system liquid crystal device) using the active matrix substrate shown in FIG. 7.

FIG. 7 is a sectional view illustrating main part of an active matrix substrate according to the invention. FIG. 7 shows a sectional structure of four transistors M7, M8, M9, and M10 constituting the application voltage inverting circuit 20 integrated on an array substrate 200. Even though not shown in FIG. 7, the memory circuits (SRAM) 10 are also formed on the array substrate 200 in the same manner. In FIG. 7, light-blocking films and aligning films are omitted.

As shown in FIG. 7, a polysilicon layer 204, which is patterned, is formed on the array substrate 200. Sources 202 and drains 206 are formed in the polysilicon layer 204 by selectively implanting impurities into the polysilicon layer 204. A gate insulating film 210 is formed so as to bury the polysilicon layer 204 and electrodes 208*a* to 208*d* made of polysilicon are formed on the crate insulating film 210.

The gate electrodes 208*b* and 208*d* are supplied with the clock signal CK and the gate electrodes 208*a* and 208*c* are supplied with the clock signal /CK which is reverse to the clock signal CK.

A first inter-layer insulating film 212 is formed on the gate electrodes 208*a* to 208*d* and contact holes are selectively formed in the first inter-layer insulating film 212. Electrodes 214*a* to 214*e* made of a light-reflective conductive material (for example, a metal such as aluminum) are connected to the sources 202 and the drains 206 via the contact holes.

The electrodes 214*a* to 214*e* are applied with a ground potential GND serving as the reference power source potential. The electrode 214*c* is connected to the memory circuit (SRAM) 10. Two values of voltages (a first voltage VDD and a second voltage GND) are supplied from the memory circuit (SRAM) 10 via a wiring N5.

A second inter-layer insulating film 216 is formed on the electrodes 214*a* to 214*e* and contact holes are selectively formed in the second inter-layer insulating film 216. A first pixel electrode 218*a* and a second pixel electrode 218*b* are connected to the electrodes 214*b* and 214*d*, respectively via the contact holes. The first pixel electrode 218*a* and the second pixel electrode 218*b* correspond to the points "c" and "d", respectively in FIG. 3. A voltage is applied to the liquid crystal element 39 by the first electrode 218*a* and the second electrode 218*b*.

FIG. 8 shows a sectional structure of a liquid device (lateral electric field system liquid crystal device) using the active matrix substrate shown in FIG. 7. As shown in FIG. 8, a liquid crystal layer 220 is interposed between the active matrix substrate shown in FIG. 7 and a counter substrate 224. Reference numeral 222 denotes a color filter layer and reference numeral 226 denotes a polarizing plate.

An electric field E parallel to the surface of the substrate as indicated by an arrow in FIG. 8 is applied to the liquid crystal layer 220 and liquid crystal molecules rotate while maintaining a posture parallel to the surface of the substrate. As a result, light transmittance of the liquid crystal layer 220 changes. In the lateral electric field system liquid crystal device (IPS liquid crystal device) shown in FIG. 8, two pixel electrodes 218*a* and 218*b* are disposed close to each other on the array substrate 200. Accordingly, the lateral electric field system liquid crystal device is advantageous in that it is easy to draw, out the electrode, load is small (the load correspond to liquid crystal capacity of only one pixel) because the common electrode LCcom is not used, and it is possible to rapidly change voltages of the pixel electrodes 218*a* and 218*b*. Thus, it is possible to perform application voltage inverting operation of the liquid crystal, which prevents image sticking from occurring, at high speed, contributing to the decrease of flickers.

Second Embodiment

With respect to a second embodiment, a circuit structure which suppresses a penetrating current in an application voltage inverting circuit 20 will be explained.

Figure 9A:
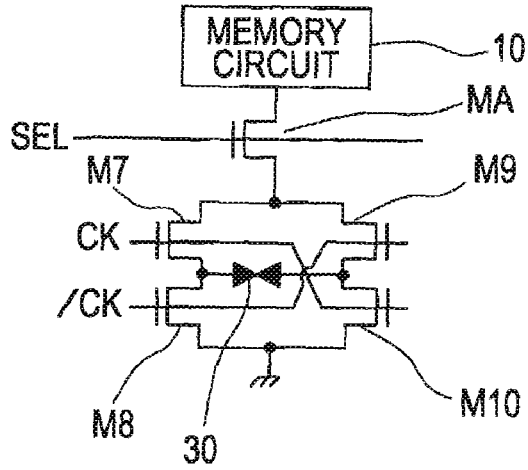
Figure 9B:
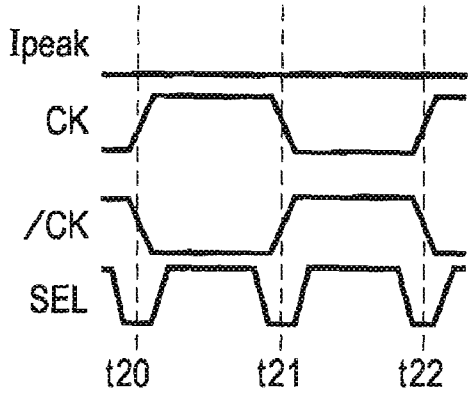
Figure 9C:
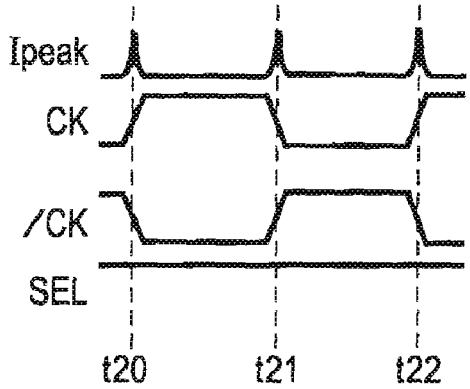

FIGS. 9A to 9C are views for explaining a circuit structure and the operation of the application voltage inverting circuit having means suppressing a penetrating current Ipeak. FIG. 9A is a circuit diagram illustrating a circuit structure of the application voltage inverting circuit, FIG. 9B is a timing diagram illustrating the operation of the application voltage inverting circuit, and FIG. 9C is a timing diagram illustrating the operation of a comparative circuit of the application voltage inverting circuit without the means suppressing the penetrating current. In FIGS. 9A to 9C, like elements are referenced by like references.

The application voltage inverting circuit 20 shown in FIG. 3 has a structure including two pairs of two MOS transistors M7 and M8, M9 and M10 each pair connected in series between the voltage supply terminal Q of the memory circuit 20 and the reference power source potential. The MOS transistors are complementarily turned on and off. During a period in which each MOS transistor is switched on or off, the transistors can be simultaneously turned on and thus it is inevitable that the penetrating current flows at that time. The penetrating current makes the reference power source potential GND fluctuate and it is natural that the fluctuation of the reference power source potential negatively influences on the circuit operation.

That is, as shown in FIG. 9C, at the timings t20, t21, and t22 when voltage levels of the complementary clock signals CK and /CK change, the two MOS transistors M7 and M8, or M9 and M10 are simultaneously turned on and the penetrating current Ipeak flows.

In the circuit shown in FIG. 9A, a penetrating current blocking transistor (switching element, MA is disposed between the memory circuit 10 and the pairs of MOS transistors M7 and M8, M9 and M10 each pair connected in series. On/off of the penetrating current blocking transistor MA is controlled by a timing signal SEL. The penetrating current blocking transistor MA in FIG. 9A is a NMOS transistor.

Voltage (current) supply from the memory circuit 10 is stopped by switching off the penetrating current blocking transistor MA at the timing when the penetrating current is generated (at the timing when the voltage levels of the complementary clock signals CK and /CK change). Accordingly, it is possible to securely block the penetrating current from flowing.

As shown in FIG. 9B, the timing signal SEL, which is used to switch off the penetrating current blocking transistor MA, becomes a low level at a timing when voltage levels of the complementary clock signals CK and /CK change. Accordingly, the penetrating current blocking transistor MIA is turned off and thus voltage (current) supply from the memory circuit 10 to the four transistors M7 to M10 is blocked. That is, it is possible to securely prevent the penetrating current Ipeak from flowing.

Third Embodiment

Next, an electronic apparatus, on which the liquid crystal device according to the first embodiment (the reflective type liquid crystal device having SRAMs and using the lateral electric field system liquid crystal) is mounted, will be explained below.

Portable Terminal Having a Sub-Panel

Figure 10:
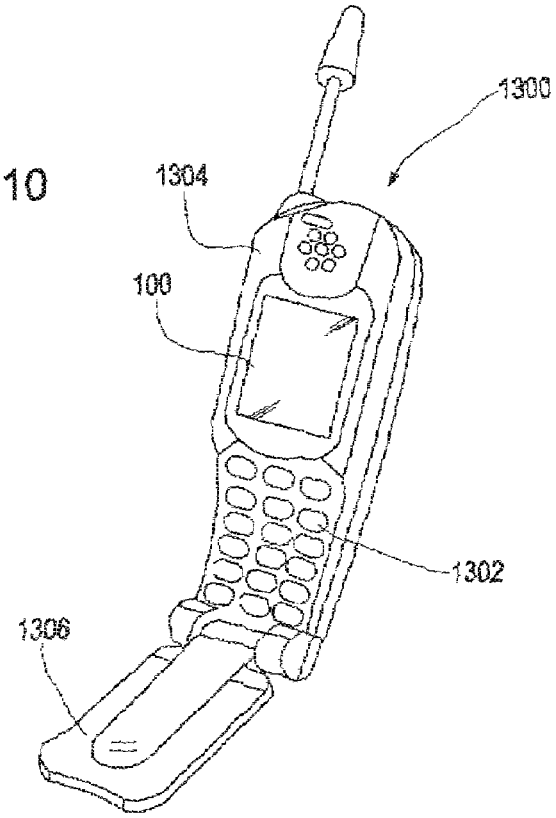
FIG. 10 is a perspective view illustrating a portable terminal, (cellular phone, PDA, or portable personal computer) having a sub-panel.

FIG. 10 is a perspective view illustrating a portable terminal (cellular phone, personal digital assistant (PDA), mobile personal computer, or the like). The portable terminal 1300 shown in FIG. 10 is a cellular phone. As shown in FIG. 10, the cellular phone 1300 includes an upper casing 1304, a sub-panel 100 disposed under the upper casing 1304, a lower casing 1306, and a manipulation key 1302. Further, a main panel is provided on the outer surface of the lower casing 1306 but the main panel is not shown in FIG. 10.

The sub-panel 100 has a structure including the liquid crystal device according to the first embodiment (the reflective type liquid crystal device with SRAMs, using the lateral electric field system liquid crystal). Since it is possible to maintain an image in the SRAMs, in the case in which an image display of the sub-panel 10 is stopped first, an image display of the main-panel (not shown) is started, and then the image display of the sub-panel 1 is recovered, the image display can be resumed by reading out the data stored in the SRAMs.

Since the portable terminal uses the lateral electric field system liquid crystal (IPS liquid crystal), it is possible to obtain a high quality display with good chromatic characteristic and a wide viewing angle by the portable terminal. Further, since a direct current offset is not generated due to the ideal voltage inverting operation which ideally inverts voltages applied to the liquid crystal and the ideal short-circuited state of the electrodes of the liquid crystal at the time when a voltage is not applied, temporal deterioration of a display image is suppressed. Since the voltage polarity inversion with respect to the liquid crystal is always symmetrically and rapidly accomplished, the portable terminal according to the invention has advantages in that the flickers do not occur and the display quality is not deteriorated. Further, since the reflective type liquid crystal which does not require a backlight is used as the sub-panel, the lifespan of the battery pack can be prolonged.

Low Power Cellular Phone

Figure 11:
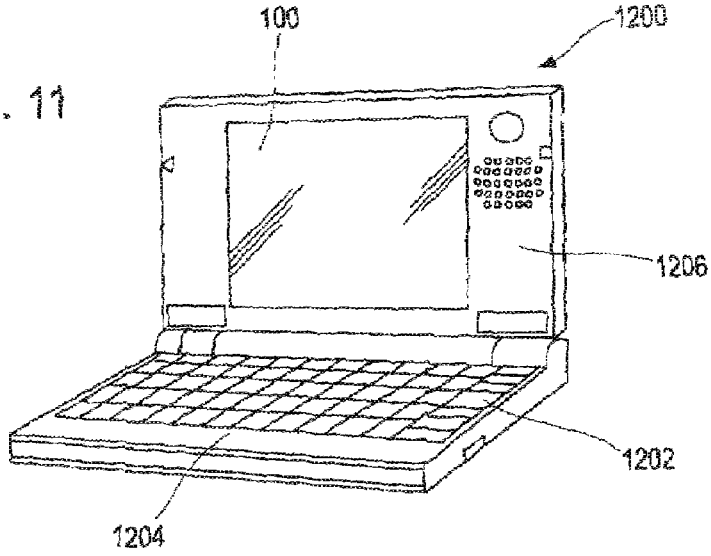
FIG. 11 is a perspective view illustrating a portable information terminal (PDA, personal computer, word processor, or the like) using a liquid crystal device of the invention.

FIG. 11 is a perspective view illustrating a portable information terminal (personal digital assistant (PDA), personal computer, word processor, or the like) having the liquid crystal device according to the first embodiment. The portable information terminal 1200 includes an upper casing 1206, a lower casing 1204, an input unit 1202 such as a keyboard, and a display panel 100 using the reflective type liquid crystal device according to the first embodiment. This portable information terminal has the same advantages as the above-mentioned portable terminals.

Reflective-Type Projector

Figure 12:
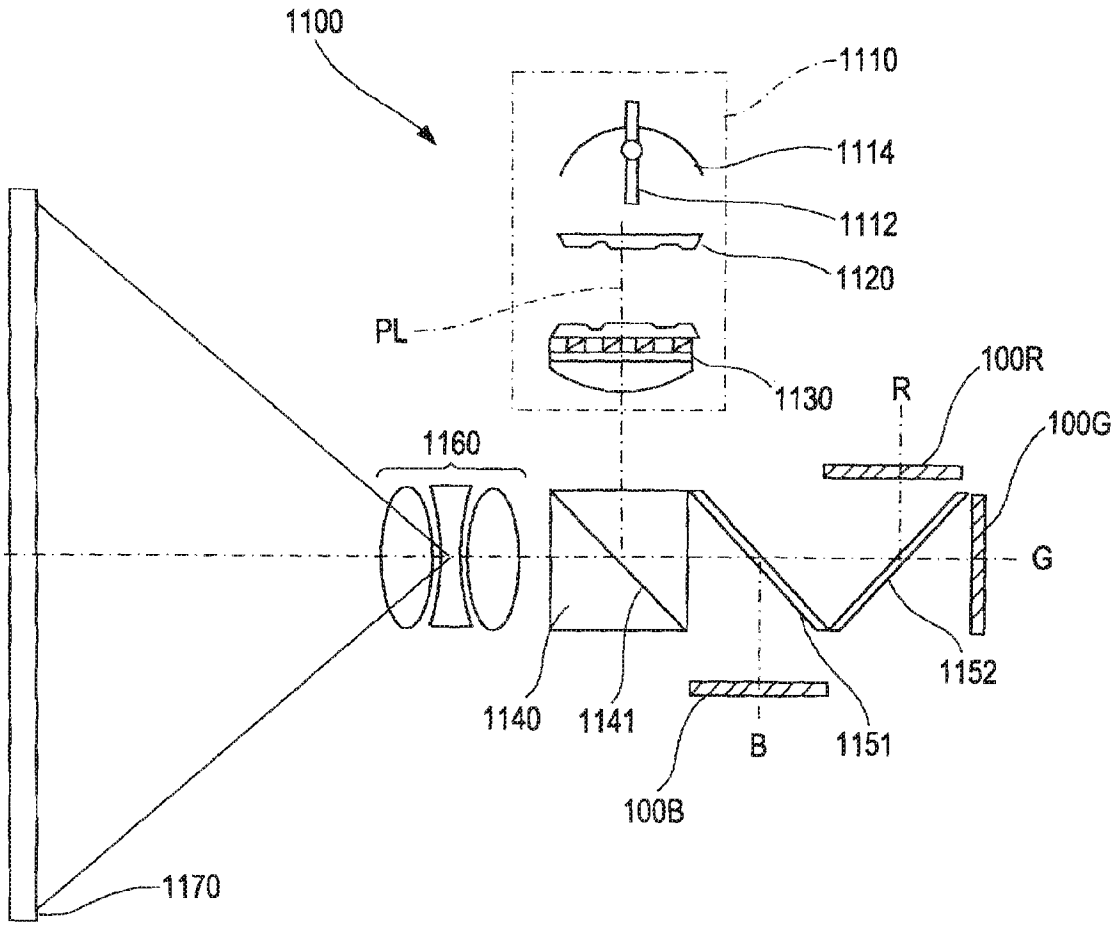
FIG. 12 is a schematic view illustrating main part of a projector (projection-type display device) using a reflective-type liquid crystal device of the invention as an optical modulator.
Figure 13A:
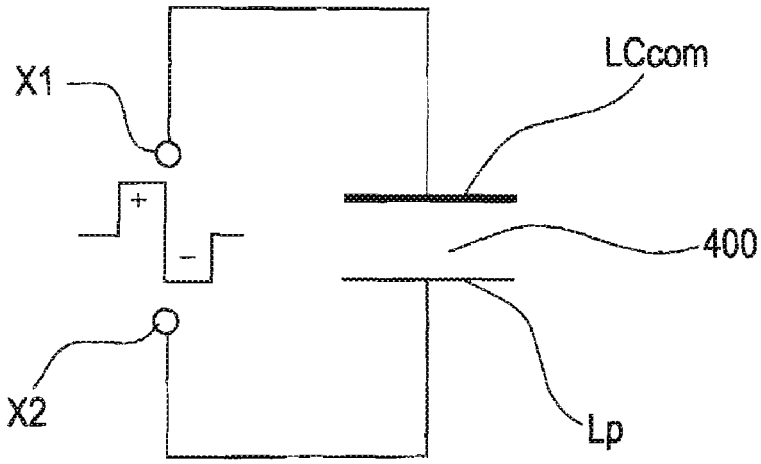
FIGS. 13A and 13B illustrate operation of preventing image sticking from occurring in a liquid crystal device (i.e., TN liquid crystal device) having a structure in which an electric field perpendicular to a substrate surface is applied to a liquid crystal layer, in which FIG. 13A relates to a case in which a voltage is applied to a liquid crystal and FIG. 13B relates to a case in which a voltage is not applied to a liquid crystal.
Figure 13B:
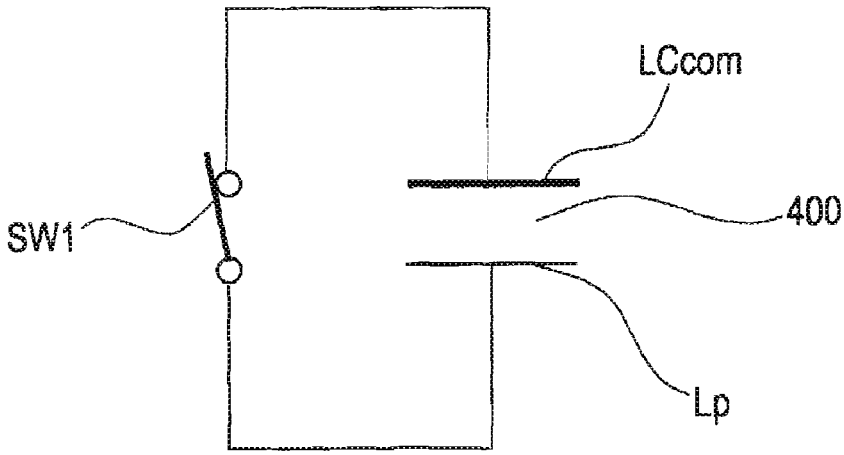
Figure 14A:
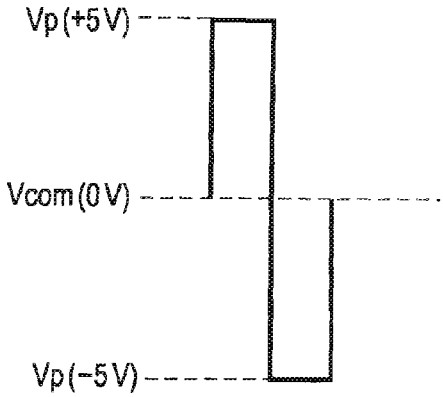
FIGS. 14A to 14C are explanatory views for explaining problems caused when inverting voltages applied to electrodes of a liquid crystal in a liquid crystal device having a memory circuit in each pixel circuit.
Figure 14B:
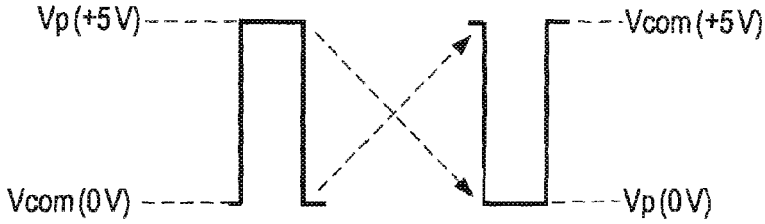
Figure 14C:
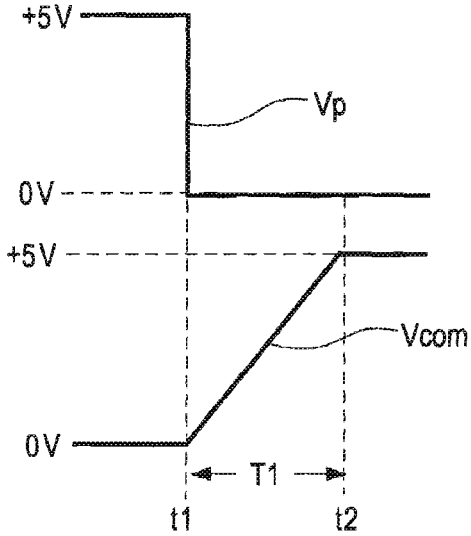
Figure 15A:
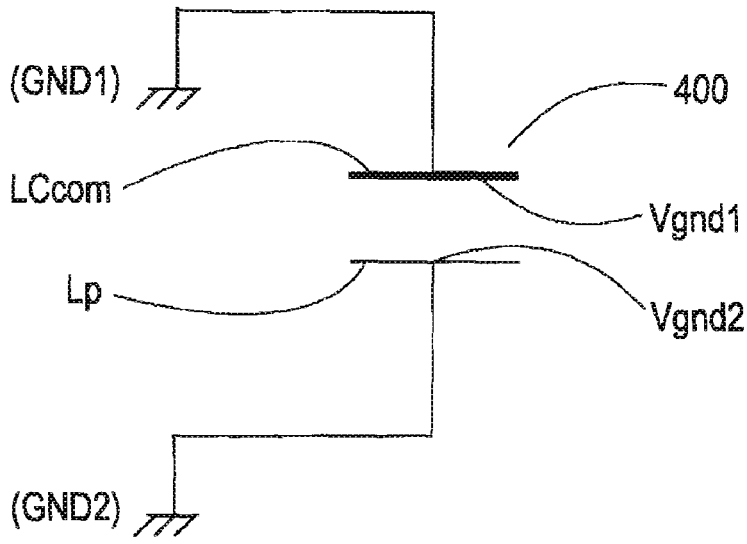
FIGS. 15A and 15B are explanatory views for explaining problems caused in a short-circuited state (same potential state) in which electrodes of a liquid crystal are short-circuited in a liquid crystal device having a memory circuit in each pixel circuit.
Figure 15B:
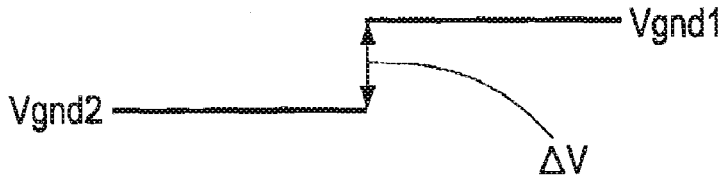

FIG. 12 shows an overall structure of main part of a projector (reflective type display device) using the reflective type liquid crystal device according to the first embodiment as an optical modulator. As shown in FIG. 12, the projector 1100 includes an polarizing illuminator 1110, a projection optical system 1160, a polarizing beam splitter 1140 (including a polarizing beam reflection surface 1141), dichroic mirrors 1151 and 1152, and reflective type liquid crystal devices 100R, 100G, and 100B corresponding to colors R, G, and B and serving as optical modulators.

As shown in FIG. 12, the polarizing illuminator 1110 is arranged along an optical axis PL of a system. In the polarizing illuminator 1110, light emitted from a lamp 1112 becomes light beams almost parallel to each other after it reflects from a reflector 1114, and then is introduced into a first integrator lens 1120. To this end, the light emitted from the lamp 1112 is split into a plurality of intermediate beams. The intermediate beams produced by splitting the light beams are turned into one kind of polarizing beams (s-polarizing beams) of which polarizing directions are the same by a polarizing conversion element 1130 having a second integrator lens on the light incidence side, and come to be emitted from the polarizing illuminator 1110.

The s-polarizing beams emitted from the polarizing Illuminator 1110 are reflected from the s-polarizing beam reflection surface 1141 of the polarizing beam splitter 1140. Of the reflected beams, beams of blue light B are reflected from a blue light reflective layer of the dichroic mirror 1151 and then are modulated by the reflective type liquid crystal device 100B. Further, of the beams penetrated through out the blue light reflective layer of the dichroic mirror 1151, beams of red light R are reflected from a red light reflective layer of a dichroic mirror 152 and are then modulated by the reflective type liquid crystal device 100R.

On the other hand, of beams penetrated through out the blue light reflective layer of the dichroic mirror 1151, beams of green light G pass through the red light reflective layer of the diachronic mirror 1152 and are modulated by the reflective type liquid crystal device 100G.

Red, green, and blue light, which underwent color light modulation performed by the liquid crystal devices 100R, 100G, and 100B, is sequentially synchronized by the dichroic mirrors 1152 and 1151 and the polarizing beam splitter 1140 and is projected on a screen 1170 by the projection optical system 1160. This portable information terminal has the above-mentioned advantages.

The invention is explained with reference to some embodiments but the invention is not limited to the above-mentioned embodiments. That is, the embodiments can be modified and applied in a variety of manners. For example, a bipolar transistor can be used as the transistor (switching element) included in the application voltage inverting circuit. Further, in the memory circuit, the SRAM may be replaced with other types of memory. The term "lateral electric field system liquid crystal" in this specification is broadly construed so as to include a variety of types of liquid crystal driven in a variety of driving method as long as an electric field applied to the liquid crystal layer is in parallel to the surface of the substrate.

As described above, according to all the embodiments, it is possible to achieve the following advantages. However, it is not necessary that the liquid crystal device of the invention simultaneously have all the advantages below. Further, the advantages described below may not be construed as the ground of improper limitation of the invention.

(1) As the lateral electric field system liquid crystal device is positively employed, driving load is light. Since voltage change of the electrodes of the liquid crystal can be rapidly performed it is possible to accomplish high precision and high speed of the voltage inversion by using the complementary clock signals CK and /CK by the use of a noble structure in which voltage supply and voltage inverting functions are completely separated.

(2) The application voltage circuit switches only voltage supply paths of the power source voltage VDD, GND from the memory circuit and the reference power source voltage GND of the application voltage inverting circuit to the liquid crystal. Accordingly, values or levels of the voltages applied to the liquid crystal do not vary but are constantly maintained. That is, the values of the voltages applied to the electrode of the liquid crystal do not change before and after the voltage inverting operation. Thus, it is possible to achieve the voltage polarity inversion with high precision. Further, although the voltage levels slightly vary in different pixels due to irregularity of distribution of liquid crystals, the voltage in the same pixel does not change before and after the voltage inverting operation. Accordingly, a direct current offset is not generated in each pixel. As a result, thus sticking does not occur and it is possible to prevent temporal deterioration of image.

(3) It is possible to simultaneously accomplish the change of voltage levels supplied to the first pixel electrode and the second pixel electrode by a simple circuit because such voltage level change is achieved by a simple manner of switching the voltage supply paths. That is, the control method is relatively simple in comparison with known techniques in which the voltage Vcom of the common electrode and the voltage Vp of the lower electrode voltage are individually controlled by different circuits, each voltage must be precisely adjusted, and the voltage level change of the voltages Vcom and Vp must be synchronized.

(4) ashen the reference power source voltage of the application voltage inverting circuit is ground potential, if the voltage from the memory circuit is 0V, the voltage applied to the electrodes of the liquid crystal become exactly 0V and the short-circuited state can be achieved when a voltage is not applied to the liquid crystal, and thus the direct current offset is not generated in the short-circuited state. Accordingly, sticking and temporal deterioration of image do not occur.

(5) The application voltage inverting circuit can be structured employing four switching elements (the first to the fourth transistors) disposed between the voltage supply terminal of the memory circuit and the reference power source potential. Accordingly, it is possible to realize synchronized switching control for all the switching elements in a simple manner, for example, by using the complementary clock signals Ck and /CK. Further, the application voltage inverting circuit can be realized in the most compact circuit because it is composed of the least number of elements.

(6) The higher level power source voltages in the memory circuit and the application voltage inverting circuit have the same value, and thus it is possible to design all the MOS transistors, which are elements of the memory circuit and the application voltage inverting circuit, to have the same size. For example, it is not necessary that the transistors in the memory circuit be high breakdown voltage transistors.

(7) The complementary clock signals CK and /CK, which drive the application voltage inverting circuit, are versatile signals used in digital circuits. The complementary clock signals CK and /CK can be generated directly using timing pulses in a digital gradation driving method (PWM driving). Accordingly, it is possible to easily obtain the complementary clock signals. Thus, it does not need to use an additional special circuit which generates a control signal. As a result, it is possible to simplify the circuit structure (system structure).

(8) The gates of the first MOS transistor M7 and the third MOS transistor M9, which transfer the voltage from the memory circuit to the liquid crystal element, are applied with a control voltage equal to or higher than the sags, of the voltage VDD+the threshold voltage Vth and thus the first and the third MOS transistors M7 and M9 are sufficiently turned on. Accordingly, the voltage 5V=VDD from the memory circuit can be supplied to the liquid crystal without voltage drop.

(9) A switching element is provided in order to prevent the penetrating current from flowing in the application voltage inverting circuit and the switching element is switched off at a timing when the penetrating current is generated. Accordingly, it is possible to securely prevent the penetrating current from flowing.

(10) The ground wiring of the memory circuit and the ground wiring of the application voltage inverting circuit are a shared wiring in the pixel circuit. Accordingly, even though the voltage level 0V varies over a plane of the liquid crystal element, both two potentials for the memory circuit and the application voltage inverting circuit vary in the same amount. As a result, there is no difference between the potentials applied to the electrodes of the liquid crystal. Further, when no voltage is applied to the liquid crystal element, it is possible to realize the short-circuited state with high precision, a direct current offset is not generated, and there is no chance of occurrence of sticking.

(11) In the reflective type liquid crystal element, it is possible to dispose an element formation region under the pixel electrodes. Since the application voltage inverting circuit according to the invention has a simple structure, there is no difficulty in arranging the memory circuit and the application voltage inverting circuit in an empty space under the pixel electrodes. As a result, it is possible to form the pixel circuit according to the invention without increasing an occupation area of the pixel circuit.

(12) The liquid crystal device according to the invention can be mounted on electronic apparatuses, such as a sub-panel of a cellular phone, a low power notebook computer, a reflective type projector, or the like. In such a case, it is possible to inhibit flickers of a still image, which is generally attributable to the voltage inverting operation, and thus it is possible to display a high quality image. Further, there is almost no chance of occurrence of the sticking because the direct current offset is negligibly generated, and thus there is almost no temporal image quality deterioration of the display image.

The invention has advantages in that it is possible to inhibit flickers and realize voltage inverting operation with high precision by using a simple circuit structure and a simple control method, and further it is possible to accomplish the short-circuited state in which a direct current offset is not generated when a voltage is not applied to a liquid crystal. Accordingly, the invention is useful for a high-performance liquid crystal device (particularly, a reflective type liquid crystal device) which does not suffer from temporal deterioration. The liquid crystal device according to the invention can be mounted on electronic apparatuses, such as a sub-panel of a cellular phone, a low power portable information terminal (personal computer), a reflective projector, or the like. As a result, it is possible to realize high-performance electronic apparatuses.

The entire disclosure of Japanese Patent Application No. 2006-328223, filed Dec. 5, 2006 is expressly incorporated by reference herein.

What is claimed is:

1. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element;

wherein the application voltage inverting circuit includes: a first switching element and a second switching element connected in series between a voltage supply terminal of the first voltage and the second voltage of the memory circuit and a reference power source potential, a third switching element and a fourth switching element connected in series between the voltage supply terminal of the first voltage and the second voltage of the memory circuit and the reference power source potential, wherein a common node of the first and the second switching elements and a common node of the third and the fourth switching elements are connected to the first pixel electrode and the second pixel electrode, respectively, of the liquid crystal element, and wherein whether any one of a pair of the first and the fourth switching elements and a pair of the first and the third switching elements is turned on is determined by a switching control signal; and wherein all the first, the second, the third, and the fourth switching elements are the same conductivity type transistors, and the switching control signal is clock signals reverse to each other in phase.

2. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element, wherein the application voltage inventing circuit includes: a first switching element and a second switching element connected in series between a voltage supply terminal of the first voltage and the second voltage of the memory circuit and a reference power source potential, a third switching element and a fourth switching element connected in series between the voltage supply terminal of the first voltage and the second voltage of the memory circuit and the reference power source potential, wherein a common node of the first and the second switching elements and a common node of the third and the fourth switching elements are connected to the first pixel electrode and the second pixel electrode, respectively, of the liquid crystal element, and wherein whether any one of a pair of the first and the fourth switching elements and a pair of the first and the third switching elements is turned on is determined by a switching control signal; and wherein voltage levels of the switching control signal are set to be values that can fully turn on the first and the third transistors and thus the first voltage from the memory circuit is applied to either the first pixel electrode or the second pixel electrode of the liquid crystal element without voltage drop.

3. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element, wherein the application voltage inverting circuit includes: a first switching element and a second switching element connected in series between a voltage supply terminal of the first voltage and the second voltage of the memory circuit and a reference power source potential, a third switching element and a fourth switching element connected in series between the voltage supply terminal of the first voltage and the second voltage of the memory circuit and the reference power source potential, wherein a common node of the first and the second switching elements and a common node of the third and the fourth switching elements are connected to the first pixel electrode and the second pixel electrode, respectively, of the liquid crystal element, and wherein whether any one of a pair of the first and the fourth switching elements and a pair of the first and the third switching elements is turned on is determined by a switching control signal; and wherein the application voltage inverting circuit further includes a switching element which blocks voltage supply from the memory circuit at a timing when a voltage level of the switching control signal changes.

4. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element, wherein the application voltage inverting circuit includes: a first switching element and a second switching element connected in series between a voltage supply terminal of the first voltage and the second voltage of the memory circuit and a reference power source potential, a third switching element and a fourth switching element connected in series between the voltage supply terminal of the first voltage and the second voltage of the memory circuit and the reference power source potential, wherein a common node of the first and the second switching elements and a common node of the third and the fourth switching elements are connected to the first pixel electrode and the second pixel electrode, respectively, of the liquid crystal element, and wherein whether any one of a pair of the first and the fourth switching elements and a pair of the first and the third switching elements is turned on is determined by a switching control signal; and wherein the liquid crystal device is a liquid crystal device having a digital driving system in which gradation is weighted by PWM, driving and the switching control signal is obtained on the basis of timing pulses used for the digital driving system.

5. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element;

wherein the reference power source potentials for the memory circuit and the application voltage inverting circuit are supplied via a common power source wiring in the pixel circuit.

6. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element;

wherein the memory circuit is an SEAM type memory cell storing one bit of data.

7. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element;

wherein the lateral electric field system liquid crystal element is an IPS system liquid crystal element.

8. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element;

wherein the liquid crystal device is a reflective type liquid crystal device, and the memory circuit and the application voltage inverting circuit are arranged in an element formation region under the first pixel electrode and the second electrode which are made of a light reflective material.

9. A liquid crystal device, comprising:

a liquid crystal element having a first pixel electrode and a second pixel electrode which control alignment of liquid crystal molecules by applying an electric field in a direction parallel to a surface of a substrate to a liquid crystal layer;

a memory circuit which is disposed in a pixel circuit and which serves as a voltage source of a first voltage and a second voltage;

an application voltage inverting circuit which is disposed in the pixel circuit and which inverts voltages applied to the liquid crystal element by controlling each of the first voltage and the second voltage so as to be supplied to either the first pixel electrode or the second pixel electrode of the liquid crystal element;

wherein the application voltage inverting circuit inverts voltages of the first and second electrodes of the liquid crystal element at a predetermined timing while an image is displayed on the liquid crystal element.

10. An electronic apparatus comprising the liquid crystal device according to claim 1.

* * * * *